US010488776B2

(12) United States Patent
Saito et al.

(10) Patent No.: US 10,488,776 B2
(45) **Date of Patent: *Nov. 26, 2019**

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Yutaka Saito, Kanagawa (JP); Sakon Takahashi, Kanagawa (JP); Moegi Iguchi, Kanagawa (JP); Mona Tasaki, Kanagawa (JP); Soutaro Kakehi, Kanagawa (JP); Yuka Yamagishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/979,484

(22) Filed: May 15, 2018

(65) Prior Publication Data

US 2019/0033736 A1 Jan. 31, 2019

(30) Foreign Application Priority Data

Jul. 28, 2017 (JP) ..... 2017-147247

(51) Int. Cl.
*G03G 9/08* (2006.01)
*G03G 9/097* (2006.01)

(52) U.S. Cl.
CPC ..... *G03G 9/09708* (2013.01); *G03G 9/08* (2013.01); *G03G 9/0819* (2013.01);
(Continued)

(58) Field of Classification Search
CPC ..... G03G 9/09708; G03G 9/09716; G03G 9/09791; G03G 9/0819; G03G 9/0827
See application file for complete search history.

(56) References Cited

U.S. PATENT DOCUMENTS 4,271,249 A * 6/1981 Gilliams ..... G03G 9/08704 399/310
8,163,453 B2 * 4/2012 Anno ..... G03G 9/0821 430/108.6

(Continued)

FOREIGN PATENT DOCUMENTS

EP 3367172 A1 * 8/2018 ..... G03G 9/08797
JP 2010044113 2/2010

(Continued)

OTHER PUBLICATIONS

Diamond, Arthur S (editor) Handbook of Imaging Materials. New York: Marcel-Dekker, Inc. (2002). pp. 178-182.*

(Continued)

*Primary Examiner* — Christopher D Rodee
(74) *Attorney, Agent, or Firm* — JCIPRNET

(57) ABSTRACT

An electrostatic charge image developing toner includes a toner particle, a lubricant particle that is externally added to the toner particle, and a strontium titanate particle that is externally added to the toner particle, that has an average primary particle diameter of 10 nm or more and 100 nm or less, that has an average primary particle circularity of 0.82 or more and 0.94 or less, and that has a primary particle circularity that becomes 84% of accumulation of more than 0.92.

19 Claims, 3 Drawing Sheets

(52) U.S. Cl.
CPC ..... *G03G 9/0827* (2013.01); *G03G 9/09733* (2013.01); *G03G 9/09766* (2013.01)

(56) References Cited

U.S. PATENT DOCUMENTS

| | | | | |
|---|---|---|---|---|
| 8,232,036 | B2 | 7/2012 | Moriya et al. | |
| 2009/0233206 | A1* | 9/2009 | Lee | G03G 9/0825 430/108.11 |
| 2010/0239971 | A1 | 9/2010 | Moriya et al. | |
| 2015/0086917 | A1* | 3/2015 | Iwasaki | G03G 9/09716 430/106.1 |
| 2018/0267416 | A1* | 9/2018 | Uchino | G03G 9/0825 |

FOREIGN PATENT DOCUMENTS

| | | | |
|---|---|---|---|
| JP | 2011137980 | 7/2011 | |
| JP | 2011203758 | 10/2011 | |
| JP | 5248511 | 7/2013 | |
| JP | 5248544 | 7/2013 | |
| WO | WO-2015152237 A1 * | 10/2015 | C01G 23/006 |

OTHER PUBLICATIONS

Marques, A.C.L.S. "Advanced Si pad detector development and SrTiO3 studies by emission channeling and hyperfine interaction experiments" Chapters 2 and 5, Tese de doutoramento, Física, Universidade de Lisboa, Faculdade de Ciências. (Year: 2009).*

* cited by examiner

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2017-147247 filed Jul. 28, 2017.

BACKGROUND

Technical Field

The present invention relates to an electrostatic charge image developing toner, an electrostatic charge image developer, and a toner cartridge.

SUMMARY

According to an aspect of the invention, there is provided an electrostatic charge image developing toner including a toner particle, a lubricant particle that is externally added to the toner particle, and a strontium titanate particle that is externally added to the toner particle, that has an average primary particle diameter of 10 nm or more and 100 nm or less, that has an average primary particle circularity of 0.82 or more and 0.94 or less, and that has a primary particle circularity that becomes 84% of accumulation of more than 0.92.

BRIEF DESCRIPTION OF THE DRAWINGS

Exemplary embodiment(s) of the present invention will be described in detail based on the following figures, wherein.

DETAILED DESCRIPTION

Figure 1A:
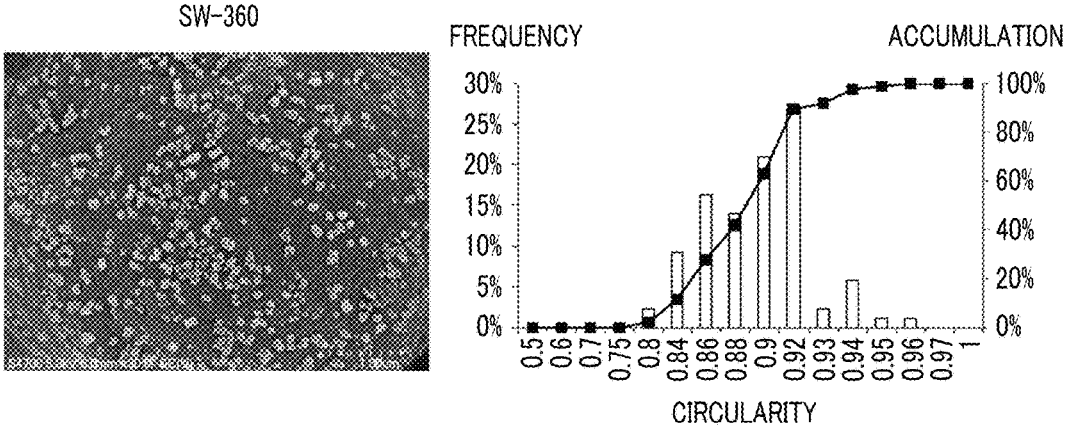
FIG. 1A is an SEM image of a toner obtained by externally adding SW-360 manufactured by Titan Kogyo, Ltd. which is an example of a strontium titanate particle and a graph of circularity distribution of strontium titanate particle obtained by analyzing the SEM image.

Hereinafter, exemplary embodiments of the present invention are described. These descriptions and examples exemplify the exemplary embodiments and do not limit the scope of the invention.

In the present disclosure, in a case of referring to the amount of each component in the composition, in a case where there are plural kinds of substances corresponding to each component in the composition, unless described otherwise, the amount means a total amount of plural substances.

In the present specification, the numerical range expressed by using "to" means a range including numerical values described before and after "to" as a lower limit value and an upper limit value.

In this disclosure, an "electrostatic charge image developing toner" is simply referred to a toner, and an "electrostatic charge image developer" is simply referred to as a "developing agent".

Electrostatic Charge Image Developing Toner

The toner according to the exemplary embodiment includes a toner particle, a lubricant particle that is externally added to the toner particle, and a strontium titanate particle that is externally added to the toner particle, that has an average primary particle diameter of 10 nm or more and 100 nm or less, that has average primary particle circularity of 0.82 or more and 0.94 or less, and the primary particle circularity that becomes 84% of the accumulation of more than 0.92. That is, the toner according to the exemplary embodiment includes at least a lubricant particle and a strontium titanate particle as external additives.

Hereinafter, a strontium titanate particle in which an average primary particle diameter is 10 nm or more and 100 nm or less, average primary particle circularity is 0.82 or more and 0.94 or less, and circularity that becomes 84% of accumulation of the primary particle is more than 0.92 is referred to as a specific strontium titanate particle.

Compared with a case where a strontium titanate particle is not externally added to a toner to which a lubricant particle is externally added, the toner according to the exemplary embodiment suppresses image density decrease and color point generation. As the mechanism, the following is assumed.

It is known that lubricant particles are used as an external additive for the purpose of suppressing the generation of a color streak due to cleaning failure of the image holding member. In a case where an image (high density image) having a high image area proportion is continuously formed using a toner to which lubricant particles are externally added, the lubricant particles isolated from the toner particles cover the surface of the carrier, the resistance of the carrier becomes high, and as a result, the developability of the toner decreases, such that the image density decreases in some cases. In a case where, after the high density image is continuously formed, an image with a low image area proportion (low density image) is continuously formed, the coating film on the carrier surface derived from the lubricant particle peels off and adheres to a developing sleeve, and this coating film is broken by mechanical stress to generate color points.

The phenomenon is suppressed by externally adding the specific strontium titanate particles to the toner. It is considered that at least a portion of the specific strontium titanate particle is isolated from the toner particle and is present on the coating film of the carrier surface derived from the lubricant particle in a dispersed manner. It is assumed that since the specific strontium titanate particle has lower resistance than the lubricant, the resistance of the coating is lowered, the resistance of the carrier is suppressed from increasing, and as a result, the image density reduction is suppressed. It is assumed that, since the specific strontium titanate particle works as a filler in the coating film, the coating film is hardly broken by mechanical stress and thus, even in a case where the specific strontium titanate particle is supplied to the image holding member, the specific strontium titanate particle is easily cleaned, so that the generation of a color spot is suppressed.

It is assumed that, since materials and shapes of the specific strontium titanate particle are (a), (b), and (c) as below, the specific strontium titanate particle efficiently is transferred to the carrier surface, is present on the coating derived from the lubricant particle in a dispersed manner, and exhibits the effect. (a) The specific strontium titanate particle has smaller specific gravity compared with the titania particle used as an external additive in the related art and has a low affinity with a binder resin of the toner, and thus the specific strontium titanate particle is easily transferred from the toner particles to the carrier. (b) The specific strontium titanate particle has an average primary particle diameter of 10 nm or more and 100 nm or less, and thus the specific strontium titanate particle is easily transferred from the toner particles to the carrier and is easily dispersed in the coating film. In a case where the average primary particle diameter is less than 10 nm, the specific strontium titanate particle is hardly transferred from the toner particle to the carrier, and in a case where the average primary particle diameter is more than 100 nm, the specific strontium titanate particle is hardly dispersed on the coating film. (c) Since the specific strontium titanate particle has a rounded shape (details are described below), the force of staying on the surface of the toner particle is weak compared with the cubic or rectangular solid strontium titanate particle, and the specific strontium titanate particle is easily transferred from the toner particles to the carrier. Compared with a cubic or rectangular strontium titanate particle, the specific strontium titanate particle is easily present on the coating film in a dispersed manner.

According to (a), (b), and (c), it is assumed that the toner according to the exemplary embodiment suppresses the image density decrease and the color point generation.

Hereinafter, the configuration of manufacturing the toner according to the exemplary embodiment is specifically described.

Toner Particle

Examples of the toner particle include a binder resin and, if necessary, a colorant, a releasing agent, and other additives.

Binder Resin

Examples of the binder resin include a homopolymer of a monomer such as styrenes (for example, styrene, parachlorostyrene, and α-methylstyrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or a vinyl-based resin including a copolymer obtained by combining two or more of these monomers.

Examples of the binder resin include a non-vinyl based resin such as an epoxy resin, a polyester resin, a polyurethane resin, a polyamide resin, a cellulose resin, a polyether resin, and a modified rosin, a mixture of these and the vinyl-based resin, or a graft polymer obtained by polymerizing a vinyl-based monomer in the coexistence thereof.

These binder resins may be used singly or two or more kinds thereof may be used in combination.

As the binder resin, although not particularly limited, a polyester resin is preferable. Examples of the polyester resin include a condensation polymer of polyvalent carboxylic acid and polyhydric alcohol.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acid (such as cyclohexanedicarboxylic acid), aromatic dicarboxylic acid (for example, terephthalic acid, isophthalic acid, phthalic acid, and naphthalene dicarboxylic acid), anhydrides thereof, or lower alkyl ester (for example, having 1 to 5 carbon atoms) thereof. Among these, as the polyvalent carboxylic acid, for example, aromatic dicarboxylic acid is preferable.

As the polyvalent carboxylic acid, trivalent or higher valent carboxylic acid having a crosslinked structure or a branched structure may be used together with the dicarboxylic acid. Examples of the trivalent or higher valent carboxylic acid include trimellitic acid, pyromellitic acid, anhydrides thereof, or lower alkyl esters (for example, having 1 to 5 carbon atoms) thereof.

The polyvalent carboxylic acid may be used singly or two or more kinds thereof may be used in combination.

Examples of the polyhydric alcohol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A and a propylene oxide adduct of bisphenol A). Among these, as the polyhydric alcohol, for example, aromatic diol or alicyclic diol is preferable, and aromatic diol is more preferable.

As the polyhydric alcohol, trihydric or higher hydric polyhydric alcohol having a crosslinked structure or a branched structure may be used together with diol. Examples of trihydric or higher hydric polyhydric alcohol include glycerin, trimethylolpropane, and pentaerythritol.

The polyhydric alcohol may be used singly or two or more kinds thereof may be used in combination.

The glass transition temperature (Tg) of the polyester resin is preferably 50° C. or more and 80° C. or less and more preferably 50° C. or more and 65° C. or less, for example.

The glass transition temperature is calculated from the DSC curve obtained by the differential scanning calorimetry (DSC), more specifically, is obtained from "Extrapolated glass transition onset temperature" disclosed in the method of obtaining the glass of transition temperature of "Method of measuring transition temperature of plastic" of JIS K 7121-1987.

The weight-average molecular weight (Mw) of the polyester resin is preferably 5,000 or more and 1,000,000 or less and more preferably 7,000 or more and 500,000 or less, for example. The number-average molecular weight (Mn) of the polyester resin is preferably 2,000 or more and 100,000 or less, for example. The molecular weight distribution Mw/Mn of the polyester resin is preferably 1.5 or more and 100 or less and more preferably 2 or more and 60 or less, for example.

The weight-average molecular weight and the number-average molecular weight of the polyester resin are measured by gel permeation chromatography (GPC). Measuring of the molecular weight by GPC is performed in a THF solvent by using GPC•HLC-8120 GPC manufactured by Tosoh Corporation as a measuring device and using TSK gel SuperHM-M (15 cm) manufactured by Tosoh Corporation. The weight-average molecular weight and the number-average molecular weight are calculated by using a molecular weight calibration curve prepared from a monodispersed polystyrene standard sample from this measurement result.

The polyester resin may be obtained by the well-known manufacturing method. Specifically, the polyester resin may be obtained, for example, by the method of setting the polymerization temperature to be 180° C. or more and 230° C. or less, depressurizing the inside of the reaction system if necessary, and performing the reaction while removing water and alcohol generated during the condensation.

In a case where the monomer of the raw material does not dissolve or compatibilize at the reaction temperature, a solvent having a high boiling point may be added as a dissolution aid for dissolving. In this case, the polycondensation reaction is performed while the dissolution aid is distilled off. In a case where a monomer with bad compatibility is present, the monomer having bad compatibility and the acid or alcohol to be polycondensed with the monomer may be condensed with each other in advance, so as to be polycondensed with the major component.

The content of the binder resin is preferably 40 mass % or more and 95 mass % or less, more preferably 50 mass % or more and 90 mass % or less, and even more preferably 60 mass % or more and 85 mass % or less with respect to the entire toner particle, for example.

Colorant

Examples of the colorant include pigments such as carbon black, chrome yellow, hansa yellow, benzidine yellow, suren yellow, quinoline yellow, pigment yellow, permanent orange GTR, pyrazolone orange, vulcan orange, watch young red, permanent red, brilliant carmine 3B, brilliant carmine 6B, dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine-based, xanthene-based, azo-based, benzoquinone-based, azine-based, anthraquinone-based, thioindigo-based, dioxazine-based, thiazine-based, azomethine-based, indico-based, phthalocyanine-based, aniline black-based, polymethine-based, triphenyl methane-based, diphenylmethane-based, and thiazole-based dyes.

The colorant may be used singly or two or more kinds thereof may be used in combination.

As the colorant, if necessary, a surface-treated colorant may be used or a dispersing agent may be used in combination. Plural colorants may be used in combination.

The content of the colorant is preferably 1 mass % or more and 30 mass % or less and more preferably 3 mass % or more and 15 mass % or less with respect to the entire toner particle, for example.

Releasing Agent

Examples of the releasing agent include hydrocarbon wax; natural wax such as carnauba wax, rice wax, and candelilla wax; synthetic or mineral/petroleum wax such as montan wax; and ester type wax such as fatty acid ester and montanic acid ester. The releasing agent is not limited thereto.

The melting temperature of the releasing agent is preferably 50° C. or more and 110° C. or less and more preferably 60° C. or more and 100° C. or less, for example.

The melting temperature is calculated from the DSC curve obtained by the differential scanning calorimetry (DSC) by "Melting peak temperature" disclosed in the method of obtaining the melting temperature of "Method of measuring transition temperature of plastic" of JIS K 7121-1987.

The content of the releasing agent is preferably 1 mass % or more and 20 mass % or less and more preferably 5 mass % or more and 15 mass % or less with respect to the entire toner particle, for example.

Other Additives

Examples of other additives include well-known additives such as a magnetic material, a charge control agent, and an inorganic powder. These additives are included in the toner particle as an internal additive.

Properties of Toner Particle

The toner particle may be a toner particle of a single layer structure or may be a toner particle of a so-called core-shell structure including a core part (core particle) and a coating layer (shell layer) coating the core part. The toner particle of a core-shell structure, for example, includes a core part including a binder resin and, if necessary, a colorant, a releasing agent, and the like, and a coating layer including a binder resin.

The volume average particle diameter (D50v) of the toner particle is preferably 2 μm or more and 10 μm or less and more preferably 4 μm or more and 8 μm or less, for example.

The volume average particle diameter of the toner particle is measured using COULTER MULTISIZER II (manufactured by Beckman Coulter, Inc.) and using ISOTON-II (manufactured by Beckman Coulter, Inc.) as an electrolytic solution. In the measurement, 0.5 mg or more and 50 mg or less of a measurement sample is added to 2 ml of a 5 mass % aqueous solution of a surfactant (preferably sodium alkylbenzenesulfonate, for example) as a dispersing agent. This is added to 100 ml or more and 150 ml or less of the electrolytic solution. A dispersion treatment of the electrolytic solution in which the sample is suspended is performed for one minute with an ultrasonic disperser, and the particle diameter of the particle having a particle diameter in the range of 2 μm or more and 60 μm or less is measured by using an aperture having an aperture diameter of 100 μm by COULTER MULTISIZER II. The number of sampling particles is 50,000. In the volume-based particle size distribution of the measured particle diameter, the particle diameter which becomes 50% of the accumulation from the small diameter side is defined as the volume average particle diameter D50v.

Lubricant Particle

Examples of the lubricant particle included in the toner as an external additive include a fluororesin particle, a fatty acid metal salt particle, and a polyolefin particle.

Examples of the fluororesin particle include particles of polytetrafluoroethylene (PTFE), a tetrafluoroethylene-perfluoroalkyl vinyl ether copolymer (PFA), a tetrafluoroethylene-hexafluoropropylene copolymer (FEP), polyvinylidene fluoride (PVDF), a tetrafluoroethylene-ethylene copolymer (ETFE), polychlorotrifluoroethylene (PCTFE), a chlorotrifluoroethylene-ethylene copolymer (ECTFE), polyvinyl fluoride (PVF), a fluoroolefin-vinyl ether copolymer, a vinylidene fluoride-tetrafluoroethylene copolymer, a vinylidene fluoride-hexafluoropropylene copolymer, and the like. These fluororesin particles may be used singly, or two or more kinds thereof may be used in combination. Among these, since it is difficult to aggregate in the toner particles, a polytetrafluoroethylene particle is preferable, for example.

Examples of the fatty acid metal salt particle include particles of metal stearate, lauric acid metal salt, linoleic acid metal salt, oleic acid metal salt, palmitic acid metal salt, metal myristate, caprylic acid metal salt, caproic acid metal salt, margaric acid metal salt, arachidic acid metal salt, behenic acid metal salt, and the like. Here, examples of the metal that forms metal salt include zinc, calcium, magnesium, barium, aluminum, lithium, and potassium, and zinc, calcium, or magnesium is preferable, for example. These fatty acid metal salt particles may be used singly, or two or more kinds thereof may be used in combination.

In view of excellent cleaning properties of the image holding member, the fatty acid metal salt particles is preferably particles of metal stearate such as zinc stearate, calcium stearate, magnesium stearate, barium stearate, aluminum stearate, lithium stearate, potassium stearate; and particles of a metal salt of lauric acid such as zinc laurate, calcium laurate, magnesium laurate, barium laurate, aluminum laurate, lithium laurate, and potassium laurate, for example.

Examples of the polyolefin particle include particles of paraffin wax, paraffin latex, microcrystalline wax, and the like. These polyolefin particles may be used singly, or two or more kinds thereof may be used in combination.

Among these, as the lubricant particle, in view of suppressing the generation of a color stripe caused by the cleaning failure of the image holding member, a fluororesin particle or a fatty acid metal salt particle is preferable, a polytetrafluoroethylene particle, a metal stearate particle, or a metal laurate particle is more preferable, and a combination of a polytetrafluoroethylene particle and at least one selected from a metal stearate particle and a metal laurate particle is even more preferable, for example.

In view of suppressing the color stripe generation caused by the cleaning failure of the image holding member, the average primary particle diameter of the lubricant particle is preferably 0.1 μm or more and 10 μm or less, more preferably 0.5 μm or more and 8 μm or less, and even more preferably 1 μm or more and 6 μm or less, for example.

The primary particle diameter of the lubricant particle according to the exemplary embodiment is a diameter of a circle having the same area as the primary particle image (so-called equivalent circle diameter), and the average primary particle diameter of the lubricant particle is a particle diameter which becomes 50% of the accumulation is obtained from the small diameter side in the number-based distribution of the primary particle diameter. The primary particle diameter of the lubricant particles is obtained by imaging a scanning electron microscope (SEM) image of the toner to which lubricant particles are externally added and performing image analysis on at least 300 lubricant particles on the toner particles in the SEM image.

In view of suppressing the color stripe generation, the externally added amount of the lubricant particle is preferably 0.01 parts by mass or more and 2.0 parts by mass or less, more preferably 0.01 parts by mass or more and 0.7 parts by mass or less, and even more preferably 0.01 parts by mass or more and 0.3 parts by mass or less, for example, with respect to 100 parts by mass of the toner particle.

Specific Strontium Titanate Particle

In the specific strontium titanate particle, the average primary particle diameter is 10 nm or more and 100 nm or less, the average primary particle circularity is 0.82 or more and 0.94 or less, and the primary particle circularity that becomes 84% of the accumulation is more than 0.92.

In view of suppressing the image density decrease and the color point generation, the specific strontium titanate particle has an average primary particle diameter of 10 nm or more and 100 nm or less. The strontium titanate particle having an average primary particle diameter of less than 10 nm hardly transferred from the toner particle to the carrier, and the strontium titanate particle having an average primary particle diameter of more than 100 nm is hardly dispersed on the coating film of the carrier surface derived from the lubricant particle.

In view of the above, the average primary particle diameter of the specific strontium titanate particle is 10 nm or more and 100 nm or less, more preferably 20 nm or more and 80 nm or less, even more preferably 20 nm or more and 60 nm or less, and even more preferably 30 nm or more and 60 nm or less, for example.

The primary particle diameter of specific strontium titanate particle in the exemplary embodiment is the diameter (so-called circle equivalent diameter) of a circle having an area the same as the primary particle image, and the average primary particle diameter of specific strontium titanate particles is a particle diameter which becomes 50% of accumulation from the small diameter side in the distribution of primary particle diameters based on the number. The primary particle diameter of the specific strontium titanate particle is obtained by imaging an electron microscope image of a toner to which the strontium titanate particle is externally added and by performing image analysis on at least 300 points of the strontium titanate particle on the toner particle. Specific measuring methods are described in the [Examples] described below.

The average primary particle diameter of the specific strontium titanate particle may be controlled, for example, by various conditions in a case where the strontium titanate particle is manufactured by a wet process.

In view of suppressing the image density decrease and the color point generation, it is preferable that the shape of the specific strontium titanate particles is a rounded shape rather than a cube or a rectangle, for example.

The crystal structure of the strontium titanate particle is a perovskite structure, and generally the particle shape is a cube or a rectangle. However, the cubic or rectangular strontium titanate particle, that the strontium titanate particle having an angle is attached to the surface of the toner particle such that the angle pricks the surface, and thus it is assumed that the strontium titanate particle is hardly transferred from the toner particle to the carrier, and is hardly dispersed on the coating film of the surface of the carrier derived from the lubricant particle.

In a case where the shape of the specific strontium titanate particle has a rounded shape, it is assumed that the force for staying on the surface of the toner particle is weak, and it is easily transferred from the toner particle to the carrier and is easily dispersed in the coating film.

In the specific strontium titanate particle, the average primary particle circularity is 0.82 or more and 0.94 or less, and the primary particle circularity is more than 0.92 at the point in which accumulation of primary particles reaches 84%.

In the exemplary embodiment, the primary particle circularity of the strontium titanate particle is $4\pi\times$(area of primary particle image)/(circumference length of primary particle image)$^2$, the average primary particle circularity is circularity from the smallest side of primary particle circularity to the biggest side of primary particle circularity in the circularity distribution at the point in which accumulation of primary particles reaches 50%, and 84% of accumulation of the primary particle circularity is circularity from the smallest side in the circularity distribution to the biggest side of primary particle circularity in the circularity distribution at the point in which accumulation of primary particles reaches 84%. The circularity of the specific strontium titanate particle is obtained by imaging an electron microscope image of a toner to which the strontium titanate particle is externally added and by performing image analysis on at least 300 points of the strontium titanate particle on the toner particle. Specific measuring methods are described in the [Examples] described below.

With respect to the specific strontium titanate particle, the primary particle circularity that becomes 84% of the accumulation is one of the indexes of a rounded shape. The primary particle circularity (hereinafter, also referred to as cumulative 84% circularity) which becomes 84% of the accumulation is described.

FIG. 1A is an SEM image of a toner obtained by externally adding SW-360 manufactured by Titan Kogyo, Ltd. which is an example of a strontium titanate particle and a graph of circularity distribution of strontium titanate particle obtained by analyzing the SEM image. As illustrated in the SEM image, in SW-360, a major particle shape is a cube, and rectangle particles and spherical particles having a relatively small particle diameter are mixed. The circularity distribution of SW-360 of this example is concentrated between 0.84 and 0.92, the average circularity is 0.888, and the cumulative 84% circularity is 0.916. It is considered that this is a reflection that the major particle shape of SW-360 is a cube, a projected image of the cube is a regular hexagon (circularity of about 0.907), a flat hexagon, a square (circularity of about 0.785), and a rectangle, a cubic strontium titanate particle adheres to the toner particles with a corner, and the projected image mostly becomes hexagonal.

According to the fact that the actual circularity distribution of SW-360 is as described above, from the theoretical circularity of the projected image of the solid, with respect to the cubic or rectangular strontium titanate particle, it is assumed that the cumulative 84% circularity of the primary particle is less than 0.92.

Figure 1B:
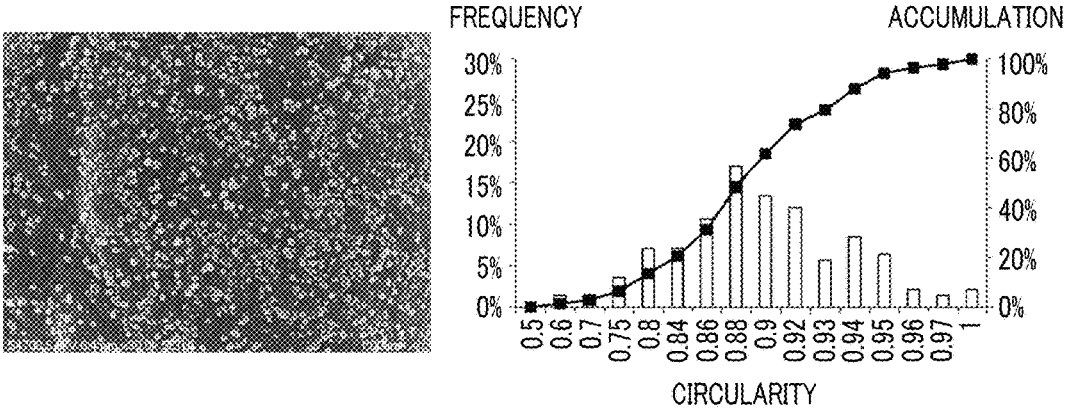
FIG. 1B is an SEM image of a toner obtained by externally adding another strontium titanate particle and a graph of circularity distribution of strontium titanate particle obtained by analyzing the SEM image.

FIG. 1B is an SEM image of a toner obtained by externally adding another strontium titanate particle and a graph of circularity distribution of strontium titanate particle obtained by analyzing the SEM image. As illustrated in the SEM image, the strontium titanate particle of this example has a rounded shape. In the strontium titanate particle of this example, the average circularity is 0.883, and the cumulative 84% circularity is 0.935.

From the above, the cumulative 84% circularity of the primary particle in the specific strontium titanate particle is one of the indexes of a rounded shape, and in a case where the cumulative 84% circularity is more than 0.92, the shape may be rounded.

In view of suppressing the image density decrease and the color point generation, the average primary particle circularity of the specific strontium titanate particle is preferably 0.82 or more and 0.94 or less, more preferably 0.84 or more and 0.92 or less, and even more preferably 0.86 or more and 0.90 or less, for example.

For the specific strontium titanate particles, the half-width of the peak of the (110) plane obtained by the X-ray diffraction method is preferably 0.2° or more and 2.0° or less and more preferably 0.2° or more and 1.0° or less, for example.

The peak of the (110) plane obtained by the X-ray diffraction method of the strontium titanate particle is a peak that appears near the diffraction angle 26=32°. This peak corresponds to a peak of the (110) plane of a perovskite crystal.

The strontium titanate particle having the particle shape of a cube or a rectangle has high crystallinity of the perovskite crystal, and the half-width of the peak of the (110) plane is generally less than 0.2°. For example, in a case where SW-350 manufactured by Titan Kogyo, Ltd. (strontium titanate particle of which the major particle shape is a cube) is analyzed, the half-width of the peak of the (110) plane is 0.15°.

Meanwhile, with respect to the strontium titanate particle in the rounded shape, the crystallinity of the perovskite crystal is relatively low, and the half-width of the peak of the (110) plane expands.

It is preferable that the specific strontium titanate particle has a rounded shape, for example. As one of the indexes of the rounded shape, the half-width of the peak of the (110) plane is preferably 0.2° or more and 2.0° or less, more preferably 0.2° or more and 1.0° or less, even more preferably 0.3° or more and 1.0° or less, and even more preferably 0.4° or more and 1.0° or less, for example.

The X-ray diffraction of the strontium titanate particle is measured by setting an X-ray diffractometer (for example, trade name: RINT Ultima-III manufactured by Rigaku Corporation) to have a line source CuKα, voltage 40 kV, current 40 mA, sample rotation speed: no rotation, divergence slit: 1.00 mm, divergence vertical limit slit: 10 mm, scattering slit: open, receiving slit: open, scanning mode: FT, counting time: 2.0 seconds, step width: 0.0050°, and operation axis: 10.0000° to 70.0000°. The half-width of the peak in the X-ray diffraction pattern in this disclosure is full width at half maximum.

It is preferable that the specific strontium titanate particle is doped with a metal element (hereinafter, also referred to as a dopant) other than titanium and strontium, for example. In a case where the specific strontium titanate particle includes a dopant, the crystallinity of the perovskite structure is decreased, and the shape becomes rounded.

The dopant of the specific strontium titanate particle is not particularly limited, as long as the dopant is a metal element other than titanium and strontium. A metal element having an ionic radius that may enter the crystal structure forming the strontium titanate particles in a case of being ionized is preferable, for example. In this point of view, the dopant of the specific strontium titanate particle is a metal element having an ionic radius in a case of being ionized is 40 μm or more and 200 μm or less and more preferably a metal element having an ionic radius of 60 μm or more and 150 μm or less, for example.

Specific examples of the dopant of the strontium titanate particle include lanthanoids, silica, aluminum, magnesium, calcium, barium, vanadium, chromium, manganese, iron, cobalt, nickel, copper, zinc, gallium, niobium, molybdenum, ruthenium, palladium, indium, antimony, tantalum, tungsten, rhenium, iridium, platinum, and bismuth. As the lanthanoid, lanthanum and cerium are preferable, for example. Among these, from the viewpoint that the doping is easily performed, and the shape of the strontium titanate particle is easily controlled, although not particularly limited, lanthanum is preferable.

As the dopant of the specific strontium titanate particles, in view of not excessively negatively charging the specific strontium titanate particle, a metal element having an electronegativity of 2.0 or less is preferable, and a metal element having an electronegativity of 1.3 or less is more preferable, for example. The electronegativity in the exemplary embodiment is Allred-Rochow electronegativity. Examples of the metal element having an electronegativity of 2.0 or less include lanthanum (electronegativity 1.08), magnesium (1.23), aluminum (1.47), silica (1.74), calcium (1.04), vanadium (1.45), chromium (1.56), manganese (1.60), iron (1.64), cobalt (1.70), nickel (1.75), copper (1.75), zinc (1.66), gallium (1.82), yttrium (1.11), zirconium (1.22), niobium (1.23), silver (1.42), indium (1.49), tin (1.72), barium (0.97), tantalum (1.33), rhenium (1.46), and cerium (1.06).

With respect to the amount of the dopant in the specific strontium titanate particles, in view of obtaining a rounded shape while having a perovskite type crystal structure, the dopant relative to strontium is preferably in the range of 0.1 mol % or more and 20 mol % or less, more preferably in the range of 0.1 mol % or more and 15 mol % or less, and even more preferably in the range of 0.1 mol % or more and 10 mol % or less, for example.

With respect to the specific strontium titanate particle, the moisture content is preferably 1.5 mass % or more and 10 mass % or less, for example. In a case where the moisture content is 1.5 mass % or more and 10 mass % or less (more preferably 2 mass % or more and 5 mass % or less, for example), the resistance of the specific strontium titanate particles becomes in an appropriate range, and the image density decrease is further suppressed. The moisture content of the specific strontium titanate particle may be controlled, for example, by manufacturing the strontium titanate particle by a wet process and adjusting the temperature and the time of the dry treatment. In the case of performing the hydrophobizing treatment on the strontium titanate particles, the moisture content of the specific strontium titanate particle may be controlled by adjusting the temperature and the time of the drying treatment after the hydrophobic treatment.

The moisture content of the specific strontium titanate particle is measured as follows.

After 20 mg of the measurement sample is left for 17 hours in a chamber having a temperature of 22° C. and a relative humidity of 55% so as to be humidified, the measurement sample is heated from 30° C. to 250° C. at a temperature rise rate of 30° C./min in a nitrogen gas atmosphere by a thermobalance (TGA-50 type manufactured by Shimadzu Corporation) in a room at a temperature of 22° C./relative humidity of 55%, and a heating loss (mass lost by heating) is measured.

The moisture content is calculated by the following formula based on the measured heating loss.

Moisture content (mass %)=(Heating loss from 30° C. to 250° C.)/(mass after humidification before heating)×100

In view of improving the action of the specific strontium titanate particle, the specific strontium titanate particle is preferably a strontium titanate particle having a hydrophobized surface and more preferably a strontium titanate particle having a hydrophobized surface by a silicon-containing organic compound, for example.

With respect to the specific strontium titanate particle, in view of improving charging performances of the toner and securing the image density, suppressing of occurring of the fogging, volume resistivity R1 (Ω·cm) is preferably 11 or more and 14 or less, more preferably 11 or more and 13 or less, and even more preferably 12 or more and 13 or less with respect to a common logarithm value log R1, for example.

The volume resistivity R1 of the specific strontium titanate particle is measured as follows.

A strontium titanate particle is put on a lower electrode plate of a measuring holding device which is a pair of circular electrode plates (made of steel) of 20 $cm^2$ which are connected to an electrometer (KEITHLEY 610C, manufactured by Keithley Instruments, Inc.) and a high voltage power supply (FLUKE 415 B) so as to form a flat layer having a thickness of 1 mm or more and 2 mm or less. Subsequently, humidification is performed for 24 hours in an environment of temperature 22° C./55% relative humidity. Subsequently, in the environment of 22° C./55% relative humidity, an upper electrode plate is disposed on the strontium titanate particle layer, 4 kg of a weight is placed on the upper electrode plate in order to remove a cavity in the strontium titanate particle layer, and the thickness of the strontium titanate particle layer is measured in that state. Subsequently, a voltage of 1,000 V is applied to both the electrode plates, and the current value is measured, so as to calculate the volume resistivity R1 from Equation (1).

Volume resistivity R1(Ω·cm)=V×S/(A1−A0)/d Equation (1):

In Equation (1), V is an applied voltage of 1,000 (V), S is an electrode plate area of 20 ($cm^2$), A1 is a measured current value (A), A0 is an initial current value (A) in a case where an applied voltage is 0 V, and d is a thickness (cm) of the strontium titanate particle layer.

The volume resistivity R1 of the specific strontium titanate particle may be controlled, for example, by volume resistivity R2 (R2 is changed by a moisture content, a type of a dopant, a dopant amount, and the like) of the strontium titanate particle before the hydrophobic treatment, types of a hydrophobic treatment agent, a hydrophobic treatment amount, and a drying temperature and drying time after the hydrophobic treatment. It is preferable that the volume resistivity R1 is controlled by any one of the moisture content of the strontium titanate particle, for example, before the hydrophobic treatment and the hydrophobic treatment amount.

The volume resistivity R2 of the strontium titanate particle before the hydrophobic treatment is preferably 6 or more and 10 or less and more preferably 7 or more and 9 or less in a common logarithm value log R2, for example. That is, the inside of the hydrophobized surface of the specific strontium titanate particle has the resistance, the inside of the strontium titanate particle has low resistance, and the surface is high resistance particles due to hydrophobic treatment. Accordingly, the chargeability of the toner is improved, the charging of the toner is easily maintained over time, and the image density decrease is suppressed. In the exemplary embodiment, in view of securing image density by improving charging performances of the toner, a difference (log R1−log R2) between the common logarithm value log R1 of the volume resistivity R1 and the common logarithm value log R2 of the volume resistivity R2 is preferably 2 or more and 7 or less and more preferably 3 or more and 5 or less, for example.

The volume resistivity R2 of the strontium titanate particle before the hydrophobized surface is formed, for example, may be controlled according to a moisture content of the strontium titanate particle, a type of the dopant, a dopant amount, and the like.

The volume resistivity R2 of the strontium titanate particle before the hydrophobic treatment is measured by a method the same as the volume resistivity R1.

In the exemplary embodiment, in view of securing the amount of strontium titanate particles which is transferred to the carrier away from the toner particles, the proportion (hereinafter referred to as a strong adhesion proportion) of a particle that strongly adheres to the toner particle in the specific strontium titanate particle is preferably 70% or less, more preferably 60% or less, and even more preferably 50% or less, for example.

The strong adhesion proportion of the specific strontium titanate particle is a value that may be obtained by a measuring method below.

Ultrasonic waves (output: 60 W, frequency: 20 kHz) are continuously applied for one hour to a dispersion in which 10 g of a toner is dispersed in 40 mL of a 0.2 mass % Triton X-100 aqueous solution while the liquid temperature of the dispersion is maintained at 20° C.±3° C. The dispersion after ultrasonic waves are applied is centrifuged at a temperature of 20° C.±3° C. under the conditions of a rotor radius of 5 cm×10,000 rpm×2 minutes, and the supernatant liquid is removed. The remaining slurry is dried to obtain the toner subjected to the separation treatment. The toner subjected to the separation treatment is a toner from which the strontium titanate particle having relatively weak adhesive force is removed.

Subsequently, a toner before the separation treatment and a toner after the separation treatment are used as samples, the fluorescent X-ray analysis is performed, the Net strength of Sr is measured, and a strong adhesion proportion is calculated from Formula (2) below.

Strong adhesion proportion (%)=(Net strength of Sr of toner after separation treatment)/(Net strength of Sr of toner before separation treatment)×100 Equation (2):

In a case where the strontium titanate particle is externally added to the toner particle, the strong adhesion proportion of the specific strontium titanate particle may be controlled by the stirring speed and the stirring time for mixing the toner particle and the strontium titanate particle. As the stirring speed becomes faster, the strong adhesion proportion becomes greater, and thus as the stirring time becomes longer, the strong adhesion proportion becomes greater.

Method of Manufacturing Specific Strontium Titanate Particle

The specific strontium titanate particle may be the strontium titanate particle itself and may be a particle obtained by hydrophobic treatment on the surface of the strontium titanate particle. The method of manufacturing the strontium titanate particle is not particularly limited, but is preferably a wet process in view of controlling a particle diameter and a shape.

Manufacturing Strontium Titanate Particle

The wet process of the strontium titanate particle is a manufacturing method of performing reaction while an aqueous alkaline solution is added to a mixed solution of a titanium oxide source and a strontium source and then performing an acid treatment. In this manufacturing method, the particle diameter of the strontium titanate particles is controlled by a mixing ratio of the titanium oxide source and the strontium source, a concentration of the titanium oxide source at the initial stage of the reaction, the temperature and the addition rate at the time of adding the aqueous alkaline solution, and the like.

As a titanium oxide source, a mineral acid peptized product of a hydrolyzate of a titanium compound is preferable, for example. Examples of the strontium source include strontium nitrate and strontium chloride.

The mixing ratio of the titanium oxide source and the strontium source is preferably 0.9 or more and 1.4 or less and more preferably 1.05 or more and 1.20 or less in a molar ratio of $SrO/TiO_2$, for example. The concentration of the titanium oxide source in the initial stage of the reaction is preferably 0.05 mol/L or more and 1.3 mol/L or less and more preferably 0.5 mol/L or more and 1.0 mol/L or less as $TiO_2$, for example.

In view of causing the shape of the strontium titanate particle to be not a cube or a rectangle but a rounded shape, it is preferable to add a dopant source to a mixed solution of the titanium oxide source and the strontium source, for example. Examples of the dopant source include an oxide of metal other than titanium and strontium. The metal oxide as the dopant source is added as a solution dissolved in, for example, nitric acid, hydrochloric acid, sulfuric acid, or the like. The addition amount of the dopant source is preferably an amount in which metal which is included in the dopant source is 0.1 moles or more and 20 moles or less and more preferably an amount in which metal is 0.5 moles or more and 10 moles or less with respect to 100 moles of strontium to be included in the strontium source, for example.

As the aqueous alkaline solution, for example, a sodium hydroxide aqueous solution is preferable. As the temperature of the reaction solution at the time of adding the aqueous alkaline solution becomes higher, a strontium titanate particle having more satisfactory crystallinity may be obtained. The temperature of the reaction solution in a case where an aqueous alkaline solution is added is preferably in the range of 60° C. to 100° C. in view of obtaining a rounded shape, for example, while having a perovskite type crystal structure. With respect to the addition rate of the aqueous alkaline solution, as the addition rate is lower, the strontium titanate particle having a larger particle diameter may be obtained, and as the addition rate is higher, the strontium titanate particle having a smaller particle diameter may be obtained. The addition rate of the aqueous alkaline solution, for example, is 0.001 equivalent/h or more and 1.2 equivalent/h or less and appropriately 0.002 equivalent/h or more and 1.1 equivalent/h or less with respect to the introduced raw material.

After the aqueous alkaline solution is added, an acid treatment is performed for the purpose of removing the unreacted strontium source. The acid treatment, for example, is performed by using hydrochloric acid, and pH of the reaction solution is adjusted from 2.5 to 7.0 and more preferably from 4.5 to 6.0, for example. After the acid treatment, the reaction solution is subjected to solid-liquid separation, and the solid content is subjected to a dry treatment, so as to obtain a strontium titanate particle.

Surface Treatment

The hydrophobic treatment on the surface of the strontium titanate particle is performed, for example, by preparing a treatment liquid obtained by mixing a solvent and a silicon-containing organic compound that is a hydrophobic treatment agent, mixing the strontium titanate particle and the treatment liquid under stirring, and further performing stirring continuously. After the surface treatment, the drying treatment is performed for the purpose of removing the solvent of the treatment liquid.

Examples of the silicon-containing organic compound used in the surface treatment of the strontium titanate particle include an alkoxysilane compound, a silazane compound, and silicone oil.

Examples of the alkoxysilane compound used in the surface treatment of the strontium titanate particle include tetramethoxysilane and tetraethoxysilane; methyltrimethoxysilane, ethyl trimethoxysilane, propyl trimethoxysilane, butyl trimethoxysilane, hexyltrimethoxysilane, n-octyltrimethoxysilane, decyltrimethoxysilane, dodecyltrimethoxysilane, vinyl triethoxysilane, methyltriethoxysilane, ethyltriethoxysilane, butyl triethoxysilane, hexyltriethoxysilane, decyltriethoxysilane, dodecyltriethoxysilane, phenyltrimethoxysilane, o-methylphenyltrimethoxysilane, p-methylphenyltrimethoxysilane, phenyltriethoxysilane, and benzyltriethoxysilane; dimethyl dimethoxysilane, dimethyl diethoxysilane, methyl vinyl dimethoxysilane, methyl vinyl diethoxysilane, diphenyldimethoxysilane, and diphenyldiethoxysilane; trimethylmethoxysilane, and trimethylethoxysilane.

Examples of silazane compounds used for surface treatment of strontium titanate particles include dimethyldisilazane, trimethyldisilazane, tetramethyldisilazane, pentamethyldisilazane, and hexamethyldisilazane.

Examples of the silicone oil used for the surface treatment of the strontium titanate particles include silicone oil such as dimethyl polysiloxane, diphenyl polysiloxane, and phenylmethyl polysiloxane; and reactive silicone oil such as amino-modified polysiloxane, epoxy-modified polysiloxane, carboxyl-modified polysiloxane, carbinol-modified polysiloxane, fluorine-modified polysiloxane, methacryl-modified polysiloxane, mercapto-modified polysiloxane, and phenol-modified polysiloxane.

As the solvent used for preparing the treatment liquid, an alcohol (for example, methanol, ethanol, propanol, and butanol) is preferable in a case where the silicon-containing organic compound is an alkoxysilane compound or a silazane compound, and hydrocarbons (for example, benzene, toluene, normal hexane, and normal heptane) is preferable in a case where the silicon-containing organic compound is silicone oil.

In the treatment liquid, the concentration of the silicon-containing organic compound is preferably 1 mass % or more and 50 mass % or less, more preferably 5 mass % or more and 40 mass % or less, and even more preferably 10 mass % or more and 30 mass % or less, for example.

The amount of the silicon-containing organic compound used for the surface treatment is preferably 1 part by mass or more and 50 parts by mass or less, more preferably 5 parts by mass or more and 40 parts by mass or less, and even more preferably 10 parts by mass or more and 30 parts by mass or less, for example, with respect to 100 parts by mass of the strontium titanate particle.

The external addition amount of the specific strontium titanate particle is preferably 0.2 parts by mass or more and 5.0 parts by mass or less, more preferably 0.4 parts by mass or more and 3.0 parts by mass or less, and even more preferably 0.5 parts by mass or more and 2.0 parts by mass or less, for example, with respect to 100 parts by mass of the toner particle.

The external addition amount of the specific strontium titanate particle is preferably 10 parts by mass or more and 50,000 parts by mass or less, more preferably 50 parts by mass or more and 10,000 parts by mass or less, and even more preferably 100 parts by mass or more and 5,000 parts by mass or less, for example, with respect to 100 parts by mass of the lubricant particle.

Other External Additives

In the range of obtaining the effect of the exemplary embodiment, the toner according to the exemplary embodiment may include other external additives other than the lubricant particle and the strontium titanate particle. Examples of the other external additives include the following inorganic particle and the resin particle.

Examples of the other external additive include an inorganic particle. Examples of the other inorganic particle include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surface of the inorganic particle as the external additive may be subjected to the hydrophobic treatment. For example, the hydrophobic treatment is performed by immersing an inorganic particle to the hydrophobic treatment agent, or the like. The hydrophobic treatment agent is not particularly limited, but examples thereof include a silane coupling agent, a silicone oil, a titanate coupling agent, and an aluminum coupling agent. These may be used singly or two or more kinds thereof may be used in combination.

The amount of the hydrophobic treatment agent is generally 1 part by mass or more and 10 parts by mass or less with respect to 100 parts by mass of the inorganic particle.

Examples of the other external additive include resin particles of polystyrene, polymethyl methacrylate, melamine resin, and the like.

The content of the other external additive is preferably 0.01 mass % or more and 5 mass % or less and more preferably 0.01 mass % or more and 2.0 mass % or less with respect to the toner particle, for example.

Method of Manufacturing Toner

Subsequently, a method of manufacturing the toner according to the exemplary embodiment is described.

The toner according to the exemplary embodiment may be obtained by externally adding an external additive to the toner particle after the toner particle is manufactured.

The toner particle may be manufactured by any one of a dry process (for example, a kneading pulverization method) and a wet process (for example, an aggregation coalescence method, a suspension polymerization method, and a dissolution suspension method). These processes are not particularly limited, and well-known processes are employed. Among these, toner particles may be obtained by a coagulation coalescence method.

Specifically, for example, in a case where toner particles are manufactured by an aggregation coalescence method, the toner particles are manufactured through a step of (a resin particle dispersion preparation step) of preparing a resin particle dispersion in which resin particles to be a binder resin are dispersed, a step of aggregating the resin particles (other particles, if necessary) in the resin particle dispersion (in a dispersion after other particles are mixed, if necessary) to form aggregated particles, and a step (coagulation/coalescence step) of heating the aggregated particle dispersion in which the aggregated particles are dispersed, and coagulating and coalescing the aggregated particles to form toner particles.

Hereinafter, respective steps are described.

In the following description, a method for obtaining toner particles including a colorant and a releasing agent is described, but a colorant and a releasing agent are used, if necessary. It is obvious that, other additives other than the colorant and the releasing agent may be used.

Resin Particle Dispersion Preparation Step

Together with the resin particle dispersion in which resin particles to be a binder resin are dispersed, for example, a colorant particle dispersion in which colorant particles are dispersed and a releasing agent particle dispersion in which releasing agent particles are dispersed are prepared.

The resin particle dispersion is prepared, for example, by dispersing resin particles in a dispersion medium by a surfactant.

Examples of the dispersion medium used for the resin particle dispersion include an aqueous medium.

Examples of the aqueous medium include water such as distilled water and ion exchanged water and alcohols. These may be used singly or two or more kinds thereof may be used in combination.

Examples of the surfactant include an anionic surfactant such as sulfate ester salt-based, sulfonate-based, phosphate ester-based, and soap-based surfactants; a cationic surfactant such as amine salt-based and quaternary ammonium salt-based surfactants; and a nonionic surfactant such as polyethylene glycol-based, alkylphenol ethylene oxide adduct-based, and polyhydric alcohol-based surfactants. Among these, particularly, an anionic surfactant and a cationic surfactant are exemplified. The nonionic surfactant may be used together with an anionic surfactant and a cationic surfactant.

The surfactant may be used singly or two or more kinds thereof may be used in combination.

With respect to the resin particle dispersion, examples of the method of dispersing the resin particles in a dispersion medium, for example, include a general dispersing method such as a rotary shearing type homogenizer, a ball mill, a sand mill, and a dyno mill having a medium. According to the types of the resin particle, the resin particles may be dispersed in the dispersion medium by a phase-transfer emulsification method. The phase-transfer emulsification method is a method of dissolving the resin to be dispersed in a hydrophobic organic solvent in which the resin is soluble and performing phase inversion from W/O to O/W by performing neutralization by adding a base to an organic continuous phase (O phase) and introducing the aqueous medium (W phase), so as to disperse the resin in a particle form in an aqueous medium.

The volume average particle diameter of the resin particle dispersed in the resin particle dispersion is preferably 0.01 μm or more and 1 μm or less, more preferably 0.08 μm or more and 0.8 μm or less, and even more preferably 0.1 μm or more and 0.6 μm or less, for example.

With respect to the volume average particle diameter of the resin particles, the particle diameter which becomes 50% of the accumulation with respect to all the particles is defined as the volume average particle diameter D50v is measured as the volume average particle diameter D50v, by subtracting the cumulative distribution from the small particle diameter side to the volume with respect to the particle size (channel) partitioned by using the particle size distribution obtained by measurement with a laser diffraction type particle size distribution determination device (for example, LA-700, manufactured by Horiba, Ltd.). The volume average particle diameter of the particles in other dispersions is measured in the same manner.

The content of the resin particle of the resin particle dispersion is preferably 5 mass % or more and 50 mass % or less and more preferably 10 mass % or more and 40 mass % or less, for example.

In the same manner as the resin particle dispersion, for example, a colorant particle dispersion and a releasing agent particle dispersion are also prepared. That is, with regard to the volume average particle diameter of the particles in the resin particle dispersion, the dispersion medium, the dispersion method, and the content of the particles, the same is applied to the releasing agent particles dispersed in the colorant particles dispersed in the colorant particle dispersion and the releasing agent particle dispersion.

Aggregated Particle Forming Step

Subsequently, the resin particle dispersion, the colorant particle dispersion, and the releasing agent particle dispersion are mixed. In the mixed dispersion, the resin particles, the colorant particles, and the releasing agent particles are heteroaggregated and aggregated particles including the resin particles, the colorant particles, and the releasing agent particles which has a diameter close to the diameter of the target toner particle are formed.

Specifically, for example, an aggregating agent is added to the mixed dispersion, pH of the mixed dispersion is adjusted to acidity (for example, pH 2 or more and 5 or less), a dispersion stabilizer is added, if necessary, heating is performed to a temperature (specifically, for example, glass transition temperature of resin particles of −30° C. or more and glass transition temperature of −10° C. or less) close to the glass transition temperature of the resin particles, and the particles dispersed in the mixed dispersion are aggregated, so as to form aggregated particles.

In the aggregated particle forming step, for example, heating may be performed after adding an aggregating agent at room temperature (for example, 25° C.) under stirring stirred with a rotary shearing type homogenizer with a rotary shearing type homogenizer, adjusting pH of the mixed dispersion to acidity (for example, pH 2 or more and 5 or less), and adding the dispersion stabilizer, if necessary.

Examples of the aggregating agent include a surfactant having a polarity opposite to that of the surfactant included in the mixed dispersion, inorganic metal salt, and a divalent or higher valent metal complex. In a case where a metal complex is used as the aggregating agent, the amount of the surfactant used is reduced and the chargeability is improved.

Together with the aggregating agent, an additive that forms a complex or a similar bond with a metal ion of the aggregating agent may be used, if necessary. As the additive, a chelating agent may be used.

Examples of the inorganic metal salt include metal salt such as calcium chloride, calcium nitrate, barium chloride, magnesium chloride, zinc chloride, aluminum chloride, and aluminum sulfate; and an inorganic metal salt polymer such as polyaluminum chloride, poly aluminum hydroxide, and calcium polysulfide polymer.

As the chelating agent, a water soluble chelating agent may be used. Examples of the chelating agent include oxycarboxylic acid such as tartaric acid, citric acid, and gluconic acid; and aminocarboxylic acid such as iminodiacetic acid (IDA), nitrilotriacetic acid (NTA), and ethylenediaminetetraacetic acid (EDTA).

The addition amount of the chelating agent is preferably 0.01 parts by mass or more and 5.0 parts by mass or less and more preferably 0.1 parts by mass or more and less than 3.0 parts by mass, for example, with respect to 100 parts by mass of the resin particle.

Coagulation Coalescence Step

Next, the aggregated particle dispersion in which the aggregated particles are dispersed is heated, for example, to be equal to or higher than the glass transition temperature of the resin particles (for example, higher than the temperature higher than the glass transition temperature of the resin particles by 10° C. to 30° C.), and the aggregated particles are coagulated and coalesced, so as to form the toner particles.

The toner particles may be obtained through the above steps.

The toner particles may be manufactured through a step of obtaining an aggregated particle dispersion in which the aggregated particles are dispersed, further mixing the aggregated particle dispersion and the resin particle dispersion in which the resin particles are dispersed, and aggregating such that the resin particles are further adhered to the surface of the aggregated particles, to form the second aggregated particles and a step of heating the second aggregated particle dispersion in which the second aggregated particles are dispersed, and coagulating and coalescing of the second aggregated particles, to form toner particles having a core-shell structure.

After completion of the coagulation coalescence step, a well-known washing step, a well-known solid-liquid separation step, and a well-known drying step are performed on to the toner particles formed in the solution, so as to obtain toner particles in a dry state. With respect to the washing step, in view of charging performances, displacement washing with ion exchanged water may be sufficiently performed. With respect to the solid-liquid separation step, in view of productivity, suction filtration, pressure filtration, and the like may be performed. With respect to the drying step, in view of productivity, freeze-drying, air stream drying, viscous flow drying, vibrating viscous drying, and the like may be performed.

Then, the toner according to the exemplary embodiment is manufactured, for example, by adding an external additive to the obtained toner particles in a dry state and performing mixing. The mixing may be performed, for example, a V blender, a HENSCHEL mixer, or a LOEDIGE mixer. If necessary, coarse particles of the toner may be removed by using a vibration sieving machine, an air sieve separator, or the like.

Electrostatic Charge Image Developer

The electrostatic charge image developer according to the exemplary embodiment at least includes the toner according to the exemplary embodiment. The electrostatic charge image developer according to the exemplary embodiment may be a single component developer including only the toner according to the exemplary embodiment and may be a double component developer obtained by mixing the toner and a carrier.

The carrier is not particularly limited, and examples thereof include well-known carriers. Examples of the carrier include a coated carrier in which the surface of a core formed of magnetic powder is coated with a resin; a magnetic powder dispersed carrier formulated by dispersing in which magnetic powder in a matrix resin; and a resin impregnated carrier in which porous magnetic powder is impregnated with a resin. The magnetic powder dispersion type carrier and the resin impregnated carrier may be a carrier in which constituent particles of the carrier are used as a core, and the surface is coated with a resin.

Examples of the magnetic powder include magnetic metal such as iron, nickel, and cobalt; and magnetic oxides such as ferrite and magnetite.

Examples of the resin for coating and the matrix resin include polyethylene, polypropylene, polystyrene, polyvinyl acetate, polyvinyl alcohol, polyvinyl butyral, PVC, polyvinyl ether, polyvinyl ketone, a vinyl chloride-vinyl acetate copolymer, a styrene-acrylic acid ester copolymer, a straight silicone resin including an organosiloxane bond, or modified products thereof, a fluorine resin, polyester, polycarbonate, a phenol resin, and an epoxy resin. Additives such as conductive particles may be included in the coating resin and the matrix resin. Examples of the conductive particles include particles of metal such as gold, silver, and copper, carbon black, titanium oxide, zinc oxide, tin oxide, barium sulfate, aluminum borate, and potassium titanate.

In order to coat the surface of the core with the resin, a method of applying the coating resin and a coating layer forming solution obtained by dissolving various additives (used, if necessary) in an appropriate solvent, and the like may be exemplified. The solvent is not particularly limited and may be selected considering the kind of resin to be used, coating suitability, and the like. Specific examples of the resin coating method include an immersion method of immersing the core in a coating layer forming solution; a spraying method of spraying a coating layer forming solution to the surface of the core material; a viscous flow bed method of spraying the coating layer forming solution in a state in which the core is suspended by viscous flow air; and a kneader coater method of mixing a core of a carrier and a coating layer forming solution in a kneader coater and then removing the solvent.

The mixing ratio (mass ratio) of the toner and the carrier in the double-component developer is preferably from toner: carrier=1:100 to 30:100 and more preferably from 3:100 to 20:100, for example.

Image Forming Device and Image Forming Method

An image forming device and an image forming method according to the exemplary embodiment are described.

The image forming device according to the exemplary embodiment includes an image holding member, a charging unit that charges a surface of the image holding member, an electrostatic charge image forming unit that forms an electrostatic charge image on the charged surface of the image holding member, an developing unit that accommodates an electrostatic charge image developer and developing an electrostatic charge image formed on the surface of the image holding member by the electrostatic charge image developer as a toner image, a transfer unit that transfers a toner image formed on the surface of the image holding member to a surface of a recording medium, and a fixing unit that fixes the toner image transferred to the surface of the recording medium. As the electrostatic charge image developer, an electrostatic charge image developer according to the exemplary embodiment is applied.

In the image forming device according to the exemplary embodiment, an image forming method (the image forming method according to the exemplary embodiment) including a charging step of charging a surface of the image holding member, an electrostatic charge image forming step of forming an electrostatic charge image on the charged surface of the image holding member, an developing step of developing an electrostatic charge image formed on the surface of the image holding member by the electrostatic charge image developer according to the exemplary embodiment as a toner image, a transfer step of transferring a toner image formed on the surface of the image holding member to a surface of a recording medium, and a fixing step of fixing the toner image transferred to the surface of the recording medium is performed.

With respect to the image forming device according to the exemplary embodiment, well-known image forming devices such as a device in a direct transfer method of directly transferring a toner image formed on a surface of an image holding member to a recording medium; a device in a intermediate transfer method of firstly transferring a toner image formed on a surface of an image holding member to a surface of an intermediate transfer member and secondarily transferring the toner image transferred to the surface of the intermediate transfer member to the surface of the recording medium; a device of including a cleaning unit that cleans the surface of the image holding member after transferring of the toner image and before charging; and a device of including a discharging unit that performs discharging by irradiating the surface of the image holding member with discharging light after the transferring of the toner image and before charging.

In a case where the image forming device according to the exemplary embodiment is a device in the intermediate transferring method, a configuration in which the transfer unit, for example, includes an intermediate transfer member in which a toner image is transferred to a surface, a primary transfer unit that firstly transfers the toner image formed on the surface of the image holding member to a surface of the intermediate transfer member, and a secondary transfer unit that secondarily transfers the toner image transferred to the surface of the intermediate transfer member to a surface of a recording medium is applied.

In the image forming device according to the exemplary embodiment, for example, a portion including a developing unit may be a cartridge structure (process cartridge) that is detachably attached to the image forming device. As the process cartridge, for example, a process cartridge including a developing unit that accommodates an electrostatic charge image developer according to the exemplary embodiment may be used.

Hereinafter, an example of the image forming device according to the exemplary embodiment is described, but the exemplary invention is not limited thereto. In the description below, major portions illustrated in the drawings are described, and explanation of the others is omitted.

Figure 2:
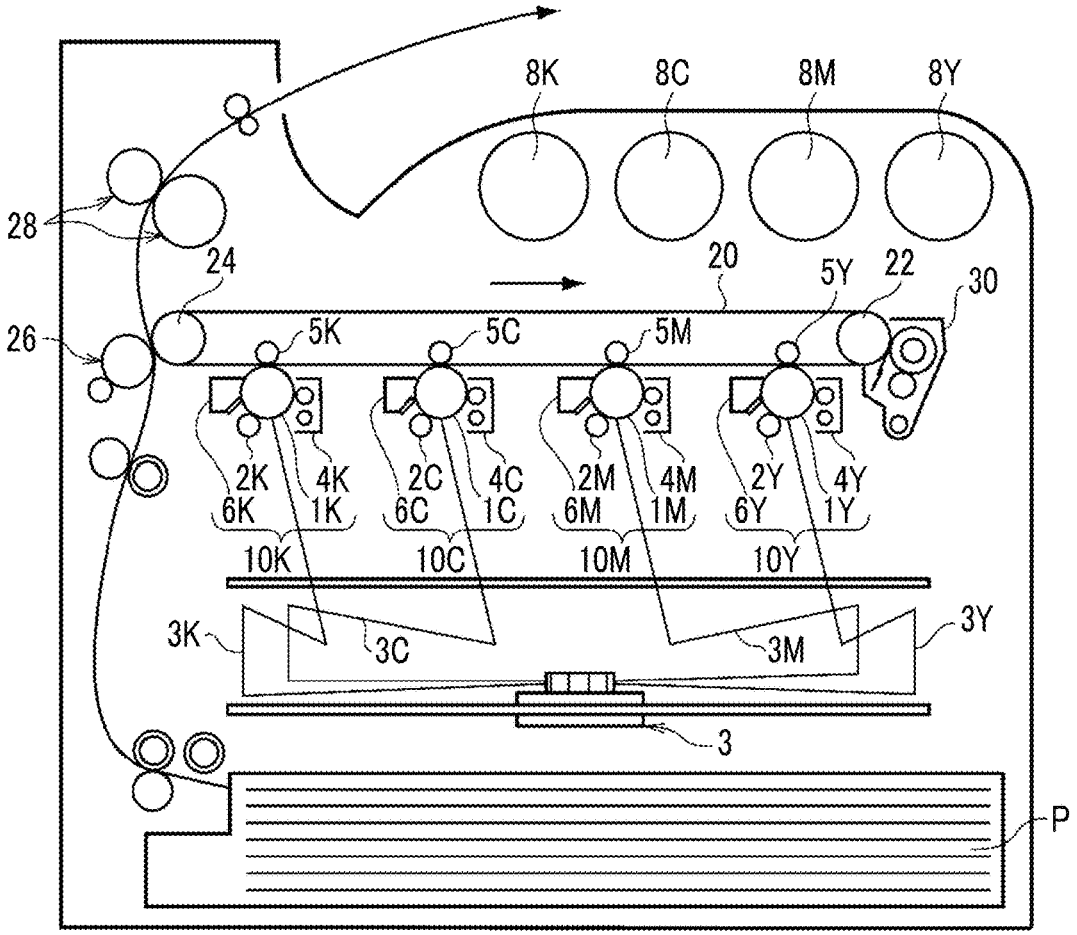
FIG. 2 is a schematic view illustrating an example of a configuration of an image forming device of an exemplary embodiment.

FIG. 2 is a schematic view illustrating the image forming device according to the exemplary embodiment.

The image forming device illustrated in FIG. 2 includes first to fourth image forming units 10Y, 10M, 10C, and 10K (image forming units) of an electrophotographic method that output images of respective colors of yellow (Y), magenta (M), cyan (C), and black (K) based on color separated image data. These image forming units (hereinafter, simply referred to as "units" in some cases) 10Y, 10M, 10C, and 10K are arranged to be parallel by being spaced in a predetermined distance from each other in a horizontal direction. These units 10Y, 10M, 10C, and 10K may be process cartridges that are detachably attached to the image forming device.

An intermediate transfer belt (an example of the intermediate transfer member) 20 is elongated on upper sides of the respective units 10Y, 10M, 10C, and 10K through the respective units. The intermediate transfer belt 20 is installed to wind a drive roller 22 and a support roller 24 that are in contact with an inner surface of the intermediate transfer belt 20 and is caused to drive in a direction from the first unit 10Y toward the fourth unit 10K. The force is applied to the support roller 24 in a direction of departing from the drive roller 22 by a spring or the like, such that tension is applied to the intermediate transfer belt 20. An intermediate transfer belt cleaning device 30 is provided on the image holding surface side of the intermediate transfer belt 20 to face the drive roller 22.

Respective toners of yellow, magenta, cyan, and black that are held in containers included in toner cartridges 8Y, 8M, 8C, and 8K are supplied to respective developing devices (an example of developing units) 4Y, 4M, 4C, and 4K of the respective units 10Y, 10M, 10C, and 10K.

The first to fourth units 10Y, 10M, 10C, and 10K have identical configuration and movements, and thus the first unit 10Y that is installed on an upper stream side in the intermediate transfer belt driving direction and forms a yellow image is representatively described.

The first unit 10Y has a photoconductor 1Y that functions as an image holding member. Around the photoconductor 1Y, a charging roller (an example of the charging unit) 2Y that charges a surface of the photoconductor 1Y in a predetermined potential, an exposing device (an example of the electrostatic charge image forming unit) 3 that exposes the charged surface with laser beams 3Y based on a color separated image signal and forms an electrostatic charge image, a developing device (an example of the developing unit) 4Y that supplies a toner charged on an electrostatic charge image and develops an electrostatic charge image, a primary transfer roller (an example of the primary transfer unit) 5Y that transfers the developed toner image on the intermediate transfer belt 20, and a photoconductor cleaning device (an example of the image holding member cleaning unit) 6Y that removes the toner remaining on the surface of the photoconductor 1Y after primary transferring.

The primary transfer roller 5Y is disposed inside the intermediate transfer belt 20 and is provided at a position facing the photoconductor 1Y. Respective bias power supplies (not illustrated) that apply primary transfer bias are connected to the primary transfer rollers 5Y, 5M, 5C, and 5K of the respective units. The respective bias power supplies change the values of the transfer bias applied to the respective primary transfer rollers according to the control of a controller (not illustrated).

Hereinafter, movements for forming a yellow image in the first unit 10Y are described.

First, prior to the movements, the surface of the photoconductor 1Y is charged by the charging roller 2Y to a potential of −600 V to −800 V.

The photoconductor 1Y is formed by laminating a photosensitive layer on a substrate having conductivity (for example, volume resistivity at 20° C. of $1\times10^{-6}$ Ωcm or less). This photosensitive layer is generally high resistance (resistance of general resin), but has properties in which the specific resistance of the portion irradiated with the laser beams changes in a case where the photosensitive layer is irradiated with laser beams. Therefore, the charged surface of the photoconductor 1Y according to image data for yellow sent from the controller (not illustrated) is irradiated with the laser beams 3Y from the exposing device 3. Accordingly, an electrostatic charge image of a yellow image pattern is formed on the surface of the photoconductor 1Y.

The electrostatic charge image is an image formed on the surface of the photoconductor 1Y by charging and is a so-called negative latent image in which the specific resistance of the irradiated portion of the photosensitive layer decreases by the laser beams 3Y such that the charged electric charged on the surface of the photoconductor 1Y flows and charges of the portion not irradiated with the laser beam 3Y are retained.

The electrostatic charge image formed on the photoconductor 1Y rotates to a predetermined developing position according to the driving of the photoconductor 1Y. In this developing position, an electrostatic charge image on the photoconductor 1Y is developed as a toner image and visualized by a developing device 4Y.

The electrostatic charge image developer including at least a yellow toner and a carrier is accommodated in the developing device 4Y. The yellow toner is frictionally electrified by being stirred inside the developing device 4Y, and has charges having the polarity the same (negative polarity) as that of the charges charged on the photoconductor 1Y and is held on a roller (an example of developer holding member). As the surface of the photoconductor 1Y passes through the developing device 4Y, the yellow toner electrostatically adheres to the latent image portion discharged on the surface of the photoconductor 1Y, and the latent image is developed with the yellow toner. The photoconductor 1Y on which the yellow toner image is formed is subsequently moved at a predetermined speed, and the toner image developed on the photoconductor 1Y is transported to a predetermined primary transfer position.

In a case where the yellow toner image on the photoconductor 1Y is transported to the primary transfer position, a primary transfer bias is applied to the primary transfer roller 5Y, the electrostatic force directed from the photoconductor 1Y toward the primary transfer roller 5Y acts on the toner image, and the toner image on the photoconductor 1Y is transferred to the intermediate transfer belt 20. The transfer bias applied at this point has a polarity (+) opposite to the polarity (−) of the toner and is controlled to +10 μA, for example, by the controller (not illustrated) in the first unit 10Y. The toner retained on the photoconductor 1Y is removed by the photoconductor cleaning device 6Y and collected.

The primary transfer bias applied to the primary transfer rollers 5M, 5C, and 5K after the second unit 10M is also controlled in accordance with the first unit.

In this manner, the intermediate transfer belt 20 to which the yellow toner image has been transferred in the first unit 10Y is transported sequentially through the second to fourth units 10M, 10C, and 10K, toner images of respective colors are superimposed and transferred in a multiplex manner.

The intermediate transfer belt 20 on which the four color toner images are transferred in a multiplex manner through the first to fourth units reaches a secondary transfer portion including an intermediate transfer belt 20, the support roller 24 in contact with the inner surface of the intermediate transfer belt, and a secondary transfer roller (an example of the secondary transfer unit) 26 disposed on the image holding surface side of the intermediate transfer belt 20. On the other hand, recording paper (an example of a recording medium) P is fed to the gap between the secondary transfer roller 26 and the intermediate transfer belt 20 via a supply mechanism at a predetermined timing, and the secondary transfer bias is applied to the support roller 24. The transfer bias applied at this point has a polarity (−) of polarity the same as the polarity (−) of the toner, and the electrostatic force directed from the intermediate transfer belt 20 toward the recording paper P acts on the toner image, and the toner image on the intermediate transfer belt 20 is transferred onto the recording paper P. The secondary transfer bias at this point is determined according to the resistance detected by a resistance detection unit (not illustrated) for detecting the resistance of the secondary transfer portion, and the voltage is controlled.

The recording paper P to which the toner image is transferred is sent to a pressure contact portion (nip portion) of a pair of fixing rollers in a fixing device (an example of the fixing unit) 28, a toner image is fixed on the recording paper P, and a fixed image is formed. The recording paper P on which fixing of the color image is completed is exported toward the discharging section, and the series of color image forming movements is ended.

Examples of the recording paper P to which the toner image is transferred include plain paper used for a copying machine or a printer in the electrophotographic method. Examples of the recording medium include an OHP sheet in addition to the recording paper P. In order to further improve the smoothness of the image surface after fixing, it is preferable that the surface of the recording paper P is also smooth, for example. For example, coated paper obtained by coating the surface of plain paper with a resin or the like, art paper for printing, and the like may be used.

Process Cartridge and Toner Cartridge

The process cartridge according to the exemplary embodiment is a process cartridge that includes a developing unit accommodating the electrostatic charge image developer according to the exemplary embodiment and developing an electrostatic charge image formed on the surface of the image holding member by the electrostatic charge image developer as the toner image and that is detachably attached to the image forming device.

The process cartridge according to the exemplary embodiment may have a configuration of including a developing unit and, for example, at least one selected from other units such as an image holding member, a charging unit, an electrostatic charge image forming unit, and a transfer unit, if necessary.

Hereinafter, an example of the process cartridge according to the exemplary embodiment is described, but the present invention is not limited thereto. In the description below, major portions illustrated in the drawings are described, and explanation of the others is omitted.

Figure 3:
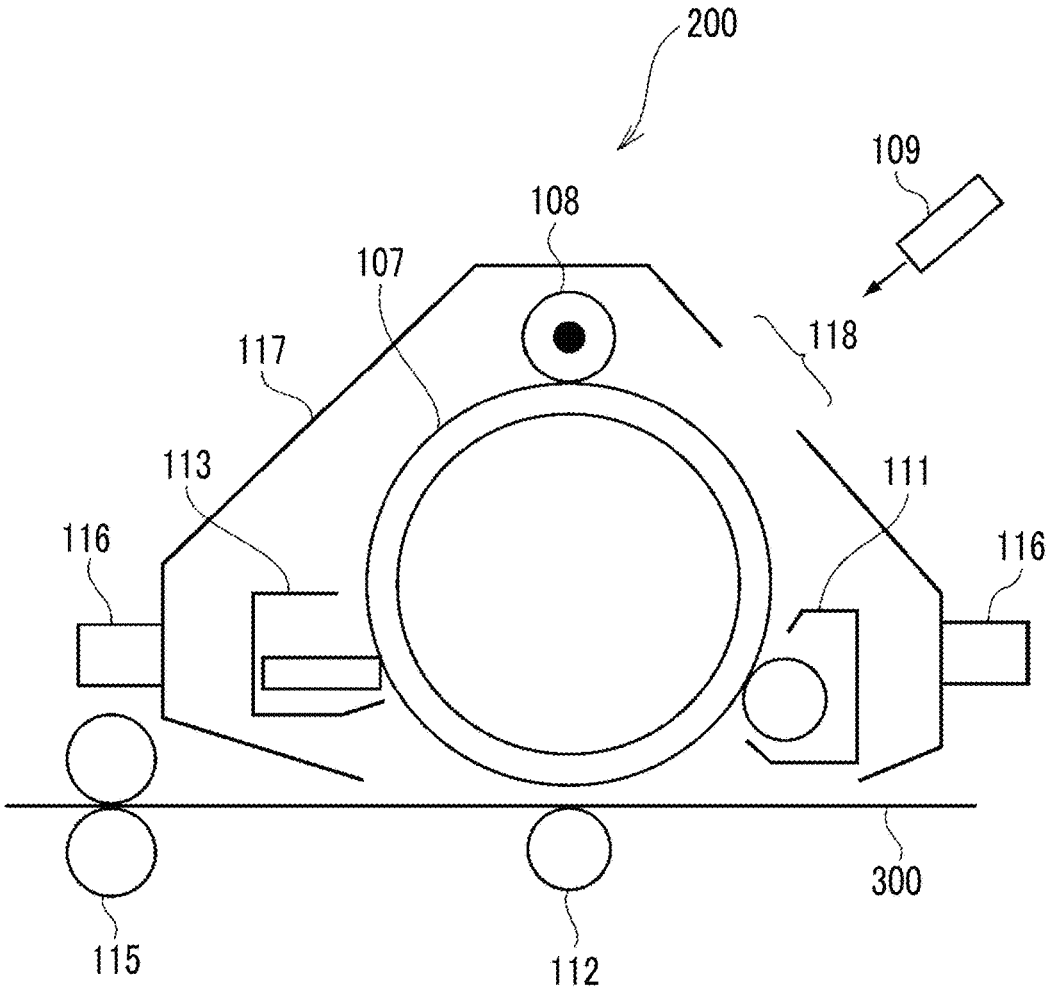
FIG. 3 is a schematic view illustrating an example of a configuration of a process cartridge of an exemplary embodiment that is detachably attached to an image forming device.

FIG. 3 is a schematic view illustrating the process cartridge according to the exemplary embodiment.

A process cartridge 200 illustrated in FIG. 3 became a cartridge combining and holding a photoconductor 107 (an example of the image holding member), a charging roll 108 (an example of the charging unit) around the photoconductor 107, a developing device 111 (an example of the developing unit), and a photoconductor cleaning device 113 (an example of the cleaning unit) in an integrated manner, for example, by a housing 117 including a mounting rail 116 and an opening 118 for exposure.

In FIG. 3, 109 indicates an exposing device (an example of the electrostatic charge image forming unit), 112 indicates a transfer device (an example of the transfer unit), 115 indicates a fixing device (an example of the fixing unit), and 300 indicates a recording paper (an example of the recording medium).

Subsequently, the toner cartridge according to the exemplary embodiment is described.

The toner cartridge according to the exemplary embodiment is a toner cartridge that includes a container that accommodates the toner according to the exemplary embodiment and is detachably attached to the image forming device. The toner cartridge includes the container that accommodates the replenishing toner for being supplied to the developing unit provided in the image forming device.

The image forming device illustrated in FIG. 2 is an image forming device having a configuration in which the toner cartridges 8Y, 8M, 8C, and 8K are detachably attached, and the developing devices 4Y, 4M, 4C, and 4K are connected to the toner cartridges corresponding to the respective colors by toner supply tubes (not illustrated). In a case where the toner that is accommodated in the container in the toner cartridge becomes less, this toner cartridge is replaced.

EXAMPLES

Hereinafter, the exemplary embodiment of the present invention is specifically described with reference to examples, but the present invention is not limited to these examples. Herein, unless otherwise specified, "part" is based on mass.

Preparation of Toner Particle

Toner Particle (1)

Preparation of Resin Particle Dispersion (1)

Terephthalic acid: 30 parts by mole

Fumaric acid: 70 parts by mole

Bisphenol A ethylene oxide adduct: 5 parts by mole

Bisphenol A propylene oxide adduct: 95 parts by mol

The above materials are introduced to a flask equipped with a stirrer, a nitrogen introduction pipe, a temperature sensor, and a rectification column, the temperature is raised to 220° C. over one hour, and 1 part of titanium tetraethoxide is added to 100 parts of the material is introduced. While generated water is distilled off, the temperature is raised to 230° C. over 30 minutes, the dehydration condensation reaction is continued for one hour at the temperature, and the reaction product is cooled. In this manner, a polyester resin having a weight-average molecular weight of 18,000 and a glass transition temperature of 60° C. is obtained.

40 parts of ethyl acetate and 25 parts of 2-butanol are introduced into a container equipped with a temperature regulating unit and a nitrogen replacing unit to obtain a mixed solvent, 100 parts of a polyester resin is gradually added and dissolved, and 10 mass % of an ammonia aqueous solution (equivalent to 3 times by the molar ratio with respect to the acid value of the resin) are put, and stirring is performed over 30 minutes. Subsequently, the inside of the container is replaced with dry nitrogen, the temperature is maintained at 40° C., and 400 parts of ion exchanged water are added dropwise at a rate of 2 parts/min while the mixed solution is stirred. After the dropwise addition is completed, the temperature is returned to room temperature (20° C. to 25° C.), and bubbling is performed for 48 hours with dry nitrogen while stirring to obtain a resin particle dispersion in which ethyl acetate and 2-butanol are reduced to 1,000 ppm or less. Ion exchanged water is added to the resin particle dispersion, and the solid content is adjusted to 20 mass % so as to obtain a resin particle dispersion (1).

Preparation of Colorant Particle Dispersion (1)

Carbon black (Regal33, manufactured by Cabot Corporation): 70 parts

Anionic surfactant (NEOGEN RK, manufactured by Daiichi Kogyo Seiyaku Co., Ltd.): 5 parts Ion exchanged water: 200 parts The materials are mixed and dispersed for 10 minutes by using a homogenizer (trade name ULTRA-TURRAX T50 manufactured by IKA-Werke GmbH & Co.). Ion exchanged water is added such that the solid content in the dispersion became 20 mass % so as to obtain a colorant particle dispersion (1) in which colorant particles having a volume average particle diameter of 170 nm are dispersed.

Preparation of Releasing Agent Particle Dispersion (1)

Paraffin wax (Nippon Seiro Co., Ltd., HNP-9): 100 parts

Anionic surfactant (NEOGEN RK, manufactured by Daiichi Kogyo Seiyaku Co., Ltd.): 1 part Ion exchanged water: 350 parts The materials are mixed, heated to 100° C., dispersed using a homogenizer (IKA-Werke GmbH & Co. KG, trade name ULTRA-TURRAX T50), and performing a distribution treatment with a MANTON GAULIN high pressure homogenizer (Gaulin Co., Ltd.), to obtain a releasing agent particle dispersion (1) (solid content amount: 20 mass %) in which the releasing agent particle having a volume average particle diameter of 200 nm is dispersed.

Manufacturing of Toner Particle (1)

Resin particle dispersion (1): 400 parts

Colorant particle dispersion (1): 32 parts

Releasing agent particle dispersion (1): 50 parts

Anionic surfactant (TaycaPower): 2 parts

The materials are introduced in a round stainless steel flask, 0.1 N nitric acid is added such that pH is adjusted to 3.5, and 30 parts of a nitric acid aqueous solution having a polyaluminum chloride concentration of 10 mass % is added. Subsequently, the mixture is dispersed at a liquid temperature of 30° C. using a homogenizer (IKA-Werke GmbH & Co. KG, trade name ULTRA TURRAX T50), heated to 45° C. in a heating oil bath, and maintained for 30 minutes. Thereafter, 100 parts of the resin particle dispersion (1) is added and is maintained for one hour, a 0.1 N sodium hydroxide aqueous solution is added such that pH is adjusted to 8.5, heating is performed to 85° C. while stirring is performed, and the mixture is maintained for five hours. Subsequently, the mixture is cooled to 20° C. at a rate of 20° C./min, filtrated, sufficiently washed with ion exchanged water, and dried, so as to obtain a toner particle (1). The volume average particle diameter of the toner particle (1) is 6.5 μm.

Manufacturing of Lubricant Particle

Polytetrafluoroethylene Particle (1)

Deionized water, paraffin wax, and ammonium perfluorooctanoate are introduced to an autoclave having an anchor type stirring blade and a temperature control jacket, the air is replaced with nitrogen gas and tetrafluoroethylene gas while heating is performed at 90° C., and trifluoroethanol is pressurized. At the same time, chlorotrifluoroethylene is introduced, and, while an ammonium persulfate aqueous solution and a disuccinic acid peroxide aqueous solution are pressurized, tetrafluoroethylene gas is continuously injected. Supplying and stirring of tetrafluoroethylene gas is stopped, and the reaction is ended. An aqueous solution of ammonium hydroperfluorononanoate is injected to the obtained latex, and hot water is added such that the temperature in the tube is adjusted to become 50° C. Subsequently, coagulation is started at a stirring speed of 500 rpm together with the addition of nitric acid, the polymer and water are separated and stirred for one hour, and water is removed. The residue is dried to obtain a polytetrafluoroethylene particle (1).

The polytetrafluoroethylene particle (1) is externally added to the polyester resin particle having a volume average particle diameter of 10 μm, and an SEM image is taken at a magnification of 40,000 times using a scanning electron microscope (S-4800, manufactured by Hitachi High-Technologies Corporation). The equivalent circle diameter of each of the 300 primary particle images is obtained, and the equivalent circle diameter which becomes cumulative 50% from the small diameter side is obtained in the distribution of circle equivalent diameter and is 0.08 μm.

Zinc Stearate Particle (1)

A solid material of zinc stearate is pulverized with a ball mill so as to obtain a zinc stearate particle (1).

The zinc stearate particle (1) is externally added to the polyester resin particle having a volume average particle diameter of 10 μm, and an SEM image is taken at a magnification of 40,000 times by using a scanning electron microscope (S-4800, manufactured by Hitachi High-Technologies Corporation). The equivalent circle diameter of each of the 300 primary particle images is obtained, and the equivalent circle diameter which becomes cumulative 50% from the small diameter side is obtained in the distribution of circle equivalent diameter and is 2.0 μm.

Manufacturing of Strontium Titanate Particle

Strontium Titanate Particle (1)

0.7 mol of metatitanic acid which is a desulfurized and deflocculated titanium source as $TiO_2$ is sampled and put into a reaction container. Subsequently, 0.77 mol of a strontium chloride aqueous solution is added to the reaction container such that the $SrO/TiO_2$ molar ratio becomes 1.1. Subsequently, a solution obtained by dissolving lanthanum oxide in nitric acid is added to the reaction container in an amount in which lanthanum becomes 2.5 moles with respect to 100 moles of strontium. The initial concentration of $TiO_2$ in the mixed solution of the three materials is caused to be 0.75 mol/L. Subsequently, the mixed solution is stirred, the mixed solution is heated to 90° C., the temperature of the liquid is maintained at 90° C., 153 mL of a 10 N sodium hydroxide aqueous solution is added over four hours under stirring, and stirring is continuously performed over one hour while the temperature of the liquid is maintained at 90° C. Subsequently, the reaction solution is cooled to 40° C., hydrochloric acid is added until pH becomes 5.5, and stirring is performed over one hour. Subsequently, the precipitate is washed by repeating decantation and redispersion in water. Hydrochloric acid is added to the slurry containing the washed precipitate, pH is adjusted to 6.5, solid-liquid separation is performed by filtration, and the solid content is dried. An ethanol solution of i-butyltrimethoxysilane is added to the dried solid content in an amount that i-butyltrimethoxysilane becomes 20 parts with respect to 100 parts of the solid content, and stirring is performed for one hour. Solid-liquid separation is performed by filtration, and the solid content is dried over seven hours in the atmosphere of 130° C., so as to obtain a strontium titanate particle (1).

Strontium Titanate Particle (2)

A strontium titanate particle (2) is manufactured in the same manner as the manufacturing of the strontium titanate particles (1), except for changing the time for the dropwise addition of the 10 N sodium hydroxide aqueous solution to one hour.

Strontium Titanate Particle (3)

A strontium titanate particle (3) is manufactured in the same manner as the manufacturing of the strontium titanate particles (1), except for changing the time for the dropwise addition of the 10 N sodium hydroxide aqueous solution to 2.8 hours.

Strontium Titanate Particle (4)

A strontium titanate particle (4) is manufactured in the same manner as the manufacturing of the strontium titanate particles (1), except for changing the time for the dropwise addition of the 10 N sodium hydroxide aqueous solution to 11 hours.

Strontium Titanate Particle (5)

A strontium titanate particle (5) is manufactured in the same manner as the manufacturing of the strontium titanate particles (1), except for changing the time for the dropwise addition of the 10 N sodium hydroxide aqueous solution to 14.5 hours.

Strontium Titanate Particle (6)

A strontium titanate particle (6) is manufactured in the same manner as the manufacturing of the strontium titanate particles (1), except for changing the time for the dropwise addition of the 10 N sodium hydroxide aqueous solution to 17 hours.

Strontium Titanate Particle (7)

SW-360 manufactured by Titan Kogyo, Ltd. is prepared as a strontium titanate particle (7). SW-360 is a strontium titanate particle which is not doped with a metal element and of which surface is untreated.

Preparing of Titanium Oxide Particle

JMT-150IB manufactured by Tayca Corporation is prepared as the titanium oxide particle (1). JMT-150IB is a titanium oxide particle of which surface is hydrophobized with isobutylsilane.

Manufacturing of Carrier

Ferrite particle (volume average particle diameter: 36 μm): 100 parts

Toluene: 14 parts

Styrene-methyl methacrylate copolymer (copolymer ratio 90/10, Mw 80,000): 2 parts Carbon black (R330, manufactured by Cabot Corporation): 0.2 parts The materials except the ferrite particle are dispersed with a stirrer to prepare a dispersion, the dispersion is put into a vacuum degassing type kneader together with a ferrite particle, stirred at 60° C. for 30 minutes, and dried under reduced pressure under stirring, so as to obtain a carrier.

Manufacturing of Toner and Developer

Comparative Example A 8 parts of the toner particle (1) and 92 parts of the carrier are introduced to a V blender and stirred for 20 minutes. Thereafter, sieving is performed with a sieve having an opening of 212 μm so as to obtain a developer.

Examples 1 to 5 and Comparative Examples 1 to 4

0.2 parts of the polytetrafluoroethylene particle (1) and 0.95 parts of any of the strontium titanate particles (1) to (7) or the titanium oxide particle (1) are added to 100 parts of the toner particle (1) in the combinations presented in Table 1, and mixing is performed for 15 minutes at a stirring circumferential speed of 30 m/seconds by using a HENSCHEL mixer. Subsequently, sieving is performed by using an oscillating sieve having an opening of 45 μm, so as to obtain an externally added toner.

8 parts of the externally added toner and 92 parts of the carrier are introduced to a V blender and stirred for 20 minutes. Thereafter, sieving is performed with a sieve having an opening of 212 μm so as to obtain a developer.

Examples 11 to 15 and Comparative Examples 11 to 14

0.2 parts of the zinc stearate particle (1) and 0.95 parts of any of the strontium titanate particles (1) to (7) or the titanium oxide particle (1) are added to 100 parts of the toner particle (1) in the combinations presented in Table 1, and mixing is performed for 15 minutes at a stirring circumferential speed of 30 m/seconds by using a HENSCHEL mixer. Subsequently, sieving is performed by using an oscillating sieve having an opening of 45 μm, so as to obtain an externally added toner.

8 parts of the externally added toner and 92 parts of the carrier are introduced to a V blender and stirred for 20 minutes. Thereafter, sieving is performed with a sieve having an opening of 212 μm so as to obtain a developer.

Example 21

0.1 parts of the polytetrafluoroethylene particle (1), 0.1 parts of the zinc stearate particle (1), and 0.95 parts of the strontium titanate particle (1) are added to 100 parts of the toner particle (1), mixed by a HENSCHEL mixer at a stirring circumferential speed of 30 m/sec for 15 minutes. Subsequently, sieving is performed by using an oscillating sieve having an opening of 45 μm, so as to obtain an externally added toner.

8 parts of the externally added toner and 92 parts of the carrier are introduced to a V blender and stirred for 20 minutes. Thereafter, sieving is performed with a sieve having an opening of 212 μm so as to obtain a developer.

Comparative Example 21

0.1 parts of the polytetrafluoroethylene particle (1) and 0.1 parts of the zinc stearate particle (1) are added to 100 parts of the toner particle (1) and mixed by a HENSCHEL mixer at a stirring circumferential speed of 30 m/sec for 15 minutes. Subsequently, sieving is performed by using an oscillating sieve having an opening of 45 μm, so as to obtain an externally added toner.

8 parts of the externally added toner and 92 parts of the carrier are introduced to a V blender and stirred for 20 minutes. Thereafter, sieving is performed with a sieve having an opening of 212 μm so as to obtain a developer.

Analysis of Toner

Shape Properties of Strontium Titanate Particle

Separately prepared toner particles and strontium titanate particles are mixed for 15 minutes at a stirring circumferential speed of 30 m/sec using a HENSCHEL MIXER. Subsequently, sieving is performed by using an oscillating sieve having an opening of 45 μm, so as to obtain an externally added toner to which strontium titanate particles are attached.

An image of the externally added toner is taken at a magnification of 40,000 times by using a scanning electron microscope (SEM) (S-4700 manufactured by Hitachi High-Technologies Corporation). Image information of 300 randomly selected strontium titanate particles is analyzed with an image processing analysis software WinRoof (Mitani Corporation) via an interface, and the circle equivalent diameter, the area, and the perimeter of each primary particle image are calculated, so as to obtain circularity=4π×(area)/(circumference length)$^2$. In the circle equivalent diameter distribution, the circle equivalent diameter which becomes 50% of the accumulation from the small diameter side is caused to be the average primary particle diameter, the circularity which becomes 50% of the accumulation from the smaller side in the circularity distribution is caused to be the average circularity, and circularity which becomes 84% of the accumulation from the smaller side in the circularity distribution is caused to be the cumulative 84% circularity.

In the case of obtaining the shape properties of the strontium titanate particles from the toner to which the strontium titanate particles and the lubricant particles are externally added, after the lubricant particles are removed from the toner, the strontium titanate particles are separated from the toner, and the shape of the separated strontium titanate particles may be measured. Specifically, the following processing and measurement methods may be applied.

In a 200 mL glass bottle, 40 mL of a 0.2 mass % aqueous solution of TRITON X-100 (manufactured by Acros Organics B.V.B.A.) and 2 g of a toner are introduced and stirring is performed 500 times, so as to be dispersed. Subsequently, ultrasonic waves are applied by using an ultrasonic homogenizer (US-300AT, manufactured by Nippon Seiki Co., Ltd.) while the liquid temperature of the dispersion is maintained at 20° C.±0.5° C. Ultrasonic wave application is continuously performed for application time: 300 seconds, output: 75 W, amplitude: 180 μm, and a distance between the ultrasonic transducer and the bottom of the container: 10 mm. Subsequently, the dispersion is centrifuged at 3,000 rpm for 2 minutes at a cooling temperature of 0° C. by using a small high-speed cooling centrifuger (manufactured by Sakuma Seisakusho Co., Ltd, M201-IVD), the supernatant is removed, and the remaining slurry is filtrated through filter paper (manufactured by Advantech Co., Ltd., qualitative filter paper No. 5C, 110 nm). The residue on the filter paper is washed twice with ion exchanged water and dried, so as to obtain a toner from which a lubricant particle is removed.

Subsequently, in a 200 mL glass bottle, 40 mL of a 0.2 mass % TRITON X-100 aqueous solution (manufactured by Acros Organics B.V.B.A.) and 2 g of the toner after the treatment are introduced and stirring is performed 500 times, so as to be dispersed. Subsequently, ultrasonic waves are applied by using an ultrasonic homogenizer (US-300AT, manufactured by Nippon Seiki Co., Ltd.) while the liquid temperature of the dispersion is maintained at 20° C.±0.5° C. Ultrasonic wave application is continuously performed for application time: 30 minutes, output: 75 W, amplitude: 180 μm, and a distance between the ultrasonic transducer and the bottom of the container: 10 mm. Subsequently, the dispersion is centrifuged at 3,000 rpm for 2 minutes at a cooling temperature of 0° C. by using a small high-speed cooling centrifuger (manufactured by Sakuma Seisakusho Co., Ltd, M201-IVD), so as to obtain a supernatant. After suction filtration is performed on the supernatant with a membrane filter (manufactured by Merck & Co., MF-Millipore membrane filter VSWP, pore size 0.025 μm), the residue on the membrane filter is dried so as to obtain strontium titanate particles.

The strontium titanate particles collected on the membrane filter are adhered onto a carbon support membrane (U1015, manufactured by EM Japan Co., Ltd.), air-blown, and then images are taken at a magnification of 320,000 times by using a transmission-type electron microscope (TEM) (Talos F200S, manufactured by FEI Co., Ltd.) equipped with an EDX apparatus (EMAX Evolution X-Max 80 mm$^2$, manufactured by Horiba Ltd.). 300 or more primary particles of strontium titanate are specified by EDX analysis from within one visual field based on the presence of Ti and Sr. Observation is performed with the TEM at an accelerating voltage of 200 kV and an emission current of 0.5 nA, and the EDX analysis is conducted under the same conditions for a detection time of 60 minutes.

Image information of specified strontium titanate particles is analyzed with an image processing analysis software WinRoof (Mitani Corporation) via an interface, and the circle equivalent diameter, the area, and the perimeter of each primary particle image are calculated, so as to obtain circularity=4π×(area)/(circumference length)$^2$. In the circle equivalent diameter distribution, the circle equivalent diameter which becomes 50% of the accumulation from the small diameter side is caused to be the average primary particle diameter, the circularity which becomes 50% of the accumulation from the smaller side in the circularity distribution is caused to be the average circularity, and circularity which becomes 84% of the accumulation from the smaller side in the circularity distribution is caused to be the cumulative 84% circularity.

X-Ray Diffraction of Strontium Titanate Particle

Each of the strontium titanate particles (1) to (7) before being externally added to the toner particles is subjected to the crystal structure analysis as a sample, by the X-ray diffraction method under the measurement conditions. The strontium titanate particles (1) to (7) have peaks corresponding to the peak of the (110) plane of the perovskite crystal near the diffraction angle of 26=32°. The half-widths of the peaks of the (110) plane are the following values, respectively.

Strontium Titanate Particle (1): Peak half-width 0.32°
Strontium Titanate Particle (2): Peak half-width 0.82°
Strontium Titanate Particle (3): Peak half-width 0.43°
Strontium Titanate Particle (4): Peak half-width 0.31°
Strontium Titanate Particle (5): Peak half-width 0.24°
Strontium Titanate Particle (6): Peak half-width 0.21°
Strontium Titanate Particle (7): Peak half-width 0.15°

Volume Resistivity R1 of Strontium Titanate Particle

The volume resistivity R1 is measured in the measuring method by using each of the strontium titanate particles (1) to (5) before being externally added to the toner particles as a sample. With respect to the strontium titanate particles (1) to (5), a common logarithm value log R1 is in the range of 11 or more and 14 or less.

Strontium titanate particle (1): Common logarithm value log R1=12.6

Strontium titanate particle (2): Common logarithm value log R1=11.4

Strontium titanate particle (3): Common logarithm value log R1=12.1

Strontium titanate particle (4): Common logarithm value log R1=13.2

Strontium titanate particle (5): Common logarithm value log R1=13.6

Moisture Content of Strontium Titanate Particle

A moisture content is measured in the measuring method by using each of the strontium titanate particles (1) to (5) before being externally added to the toner particles as a sample. In the strontium titanate particles (1) to (5), the moisture content is in the range of 2 mass % or more and 5 mass % or less.

Strontium titanate particle (1): Moisture content 3.6 mass %

Strontium titanate particle (2): Moisture content 4.2 mass %

Strontium titanate particle (3): Moisture content 3.8 mass %

Strontium titanate particle (4): Moisture content 2.8 mass %

Strontium titanate particle (5): Moisture content 2.4 mass %

Strong Adhesion Proportion of Strontium Titanate Particle

According to the measurement method, the strong adhesion proportion of the strontium titanate particles in the toner to which the strontium titanate particle is externally added is measured.

Evaluation of Developer

The developer of each example is accommodated in a developing device of a modified machine of an image forming device "ApeosPort-IV C5575 (manufactured by Fuji Xerox Co., Ltd.)" (a modified machine with a concentration automatic control sensor disconnected in environmental fluctuation). After the image forming device accommodating the developer is left for one day at a low temperature and low humidity environment (temperature: 10° C., relative humidity: 15%), image forming of (1) to (5) as below is continuously performed on A4 size plain paper under the environment of a temperature of 10° C. and relative humidity of 15%.

(1) Printing 100 sheets of images having the image density of 20%.

(2) Printing one sheet of patch image including a patch having the image density of 100% (solid image).

(3) Printing 100,000 sheets of images having the image density of 20%.

(4) Printing one sheet of patch image including a patch having the image density of 100% (solid image).

(5) Printing 100,000 sheets of images having the image density of 1%.

Color Stripe

In (3), 100 sheets of 99,901 to 100,000 sheets are visually observed and the generation of color stripes is classified as below.

G1: A color stripe is not generated

G2: A color stripe is generated in one sheet or more and five sheets or less

G3: A color stripe is generated in six sheets or more and ten sheets or less

G4: A color stripe is generated in eleven sheets or more

Image Density

In (2), the density of the patch of the solid image is measured with an image densitometer X-Rite 938 (manufactured by X-Rite, Incorporated), and the measured value is set as "Density 1". In (4), the density of the patch of the solid image is measured with the same image densitometer, and the measured value is set as "Density 2". ΔDensity=(Density 1−Density 2) is calculated, and the reduction in the image density is classified as below.

G1: 0≤ΔDensity≤0.15

G2: 0.15<ΔDensity≤0.25

G3: 0.25<ΔDensity≤0.35

G4: 0.35<ΔDensity

Color Point

In (5), 100 sheets of 99,901 to 100,000 sheets are visually observed and the generation of color points is classified as below.

G1: A color point is not generated

G2: A color point is generated in one sheet or more and five sheets or less

G3: A color point is generated in six sheets or more and ten sheets or less

G4: A color point is generated in eleven sheets or more

TABLE 1

| | | Titanium oxide particle | | Strontium titanate particle | | | | Strong adhesion proportion | | | |
|---|---|---|---|---|---|---|---|---|---|---|---|
| | Lubricant particle | No. | Average primary particle diameter [nm] | No. | Average primary particle diameter [nm] | Average circularity | Cumulative 84% circularity | of strontium titanate particle [%] | Color strip | Image density | Color point |
| Comparative Example A | — | | — | | | — | | — | G4 | G1 | G1 |
| Comparative Example 1 | Polytetrafluoroethylene particle (1) | | — | | | — | | — | G2 | G4 | G4 |
| Comparative Example 2 | Polytetrafluoroethylene particle (1) | (1) | 55 | | | — | | — | G2 | G4 | G4 |
| Example 1 | Polytetrafluoroethylene particle (1) | | — | (1) | 53 | 0.925 | 0.952 | 58 | G2 | G1 | G1 |
| Example 2 | Polytetrafluoroethylene particle (1) | | — | (2) | 25 | 0.938 | 0.973 | 68 | G2 | G2 | G2 |
| Example 3 | Polytetrafluoroethylene particle (1) | | — | (3) | 38 | 0.931 | 0.958 | 63 | G2 | G2 | G2 |

TABLE 1-continued

| | Lubricant particle | Titanium oxide particle No. | Titanium oxide particle Average primary particle diameter [nm] | Strontium titanate particle No. | Strontium titanate particle Average primary particle diameter [nm] | Strontium titanate particle Average circularity | Strontium titanate particle Cumulative 84% circularity | Strong adhesion proportion of strontium titanate particle [%] | Color strip | Image density | Color point |
|---|---|---|---|---|---|---|---|---|---|---|---|
| Example 4 | Polytetrafluoroethylene particle (1) | | — | (4) | 81 | 0.903 | 0.932 | 50 | G2 | G2 | G3 |
| Example 5 | Polytetrafluoroethylene particle (1) | | — | (5) | 94 | 0.856 | 0.924 | 46 | G2 | G3 | G3 |
| Comparative Example 3 | Polytetrafluoroethylene particle (1) | | — | (6) | 108 | 0.824 | 0.922 | 43 | G2 | G4 | G4 |
| Comparative Example 4 | Polytetrafluoroethylene particle (1) | | — | (7) | 80 | 0.888 | 0.916 | 72 | G2 | G3 | G4 |
| Comparative Example 11 | Zinc stearate particle (1) | | — | | | — | | — | G3 | G4 | G4 |
| Comparative Example 12 | Zinc stearate particle (1) | (1) | 55 | | | — | | — | G3 | G4 | G4 |
| Example 11 | Zinc stearate particle (1) | | — | (1) | 53 | 0.925 | 0.952 | 58 | G3 | G1 | G2 |
| Example 12 | Zinc stearate particle (1) | | — | (2) | 25 | 0.938 | 0.973 | 68 | G3 | G2 | G1 |
| Example 13 | Zinc stearate particle (1) | | — | (3) | 38 | 0.931 | 0.958 | 63 | G3 | G2 | G1 |
| Example 14 | Zinc stearate particle (1) | | — | (4) | 81 | 0.903 | 0.932 | 50 | G3 | G2 | G2 |
| Example 15 | Zinc stearate particle (1) | | — | (5) | 94 | 0.856 | 0.924 | 46 | G3 | G3 | G2 |
| Comparative Example 13 | Zinc stearate particle (1) | | — | (6) | 108 | 0.824 | 0.922 | 43 | G3 | G4 | G4 |
| Comparative Example 14 | Zinc stearate particle (1) | | — | (7) | 80 | 0.888 | 0.916 | 72 | G3 | G3 | G4 |
| Comparative Example 21 | Polytetrafluoroethylene particle (1), Zinc stearate particle (1) | | — | | | — | | — | G1 | G4 | G4 |
| Example 21 | Polytetrafluoroethylene particle (1), Zinc stearate particle (1) | | — | (1) | 53 | 0.925 | 0.952 | 58 | G1 | G1 | G1 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle;

a lubricant particle that is externally added to the toner particle; and a strontium titanate particle that is externally added to the toner particle, that is doped with a metal element other than titanium and strontium, that has an average primary particle diameter of 10 nm or more and 100 nm or less, that has an average primary particle circularity of 0.82 or more and 0.94 or less, and that has a primary particle circularity of more than 0.92 at the point in which accumulation of primary particles reaches 84%.

2. The electrostatic charge image developing toner according to claim 1, wherein an average primary particle diameter of the strontium titanate particle is 20 nm or more and 80 nm or less.

3. The electrostatic charge image developing toner according to claim 2, wherein an average primary particle diameter of the strontium titanate particle is 30 nm or more and 60 nm or less.

4. The electrostatic charge image developing toner according to claim 1, wherein, in the strontium titanate particle, a half-width of a peak of a 110 plane obtained by an X-ray diffraction method is 0.2° or more and 1.0° or less.

5. The electrostatic charge image developing toner according to claim 1, wherein a proportion of a particle that strongly adheres to the toner particle, among the strontium titanate particles is 70% or less.

6. The electrostatic charge image developing toner according to claim 5, wherein the proportion of the particle that strongly adheres to the toner particle, among the strontium titanate particles is 50% or less.

7. The electrostatic charge image developing toner according to claim 1, wherein the metal element is a metal element in which an ionic radius in a case of being ionized is 40 pm or more and 200 pm or less.

8. The electrostatic charge image developing toner according to claim 1, wherein the metal element is lanthanum.

9. The electrostatic charge image developing toner according to claim 1, wherein the strontium titanate particle is a strontium titanate particle having a hydrophobized surface.

10. The electrostatic charge image developing toner according to claim 9, wherein the strontium titanate particle is a strontium titanate particle having a surface hydrophobized with a silicon-containing organic compound.

11. The electrostatic charge image developing toner according to claim 9, wherein volume resistivity R1 of the strontium titanate particle is 11 or more and 14 or less at a common logarithm value log R1.

12. The electrostatic charge image developing toner according to claim 1, wherein a moisture content of the strontium titanate particle is 1.5 mass % or more and 10 mass % or less.

13. The electrostatic charge image developing toner according to claim 12, wherein a moisture content of the strontium titanate particle is 2 mass % or more and 5 mass % or less.

14. The electrostatic charge image developing toner according to claim 1, wherein the lubricant particle is at least one selected from the group consisting of a fluororesin particle and a fatty acid metal salt particle.

15. The electrostatic charge image developing toner according to claim 14, wherein the lubricant particle is at least one selected from the group consisting of a polytetrafluoroethylene particle, a metal stearate particle, and a metal laurate particle.

16. The electrostatic charge image developing toner according to claim 1, wherein the lubricant particle is included in a range of 0.01 parts by mass or more and 2.0 parts by mass or less with respect to 100 parts by mass of the toner particle.

17. The electrostatic charge image developing toner according to claim 1, wherein the strontium titanate particle is included in a range of 10 parts by mass or more and 50,000 parts by mass or less with respect to 100 parts by mass of the lubricant particle.

18. An electrostatic charge image developer comprising:

the electrostatic charge image developing toner according to claim 1.

19. A toner cartridge comprising:

a container that accommodates the electrostatic charge image developing toner according to claim 1, wherein the toner cartridge is detachably attached to an image forming device.

* * * * *